US007241172B2

(12) United States Patent
Rodrigues et al.

(10) Patent No.: US 7,241,172 B2
(45) Date of Patent: Jul. 10, 2007

(54) COAXIAL CABLE CONNECTOR

(75) Inventors: Julio Rodrigues, Collierville, TN (US); Randy Ward, Cordova, TN (US); Brian Thayer, Horseheads, NY (US)

(73) Assignee: Thomas & Betts International Inc., Wilmington, DE (US)

( * ) Notice: Subject to any disclaimer, the term of this patent is extended or adjusted under 35 U.S.C. 154(b) by 0 days.

(21) Appl. No.: 11/104,334

(22) Filed: Apr. 12, 2005

(65) Prior Publication Data

US 2005/0233636 A1 Oct. 20, 2005

Related U.S. Application Data

(60) Provisional application No. 60/562,953, filed on Apr. 16, 2004, provisional application No. 60/562,952, filed on Apr. 16, 2004.

(51) Int. Cl.
*H01R 9/05* (2006.01)

(52) U.S. Cl. ..... 439/578

(58) Field of Classification Search ..... 439/578, 439/585, 584, 583, 937, 149
See application file for complete search history.

(56) References Cited

U.S. PATENT DOCUMENTS

| | | | | |
|---|---|---|---|---|
| 1,667,485 | A | 4/1928 | MacDonald | |
| 2,258,737 | A | 10/1941 | Browne | |
| 2,544,654 | A * | 3/1951 | Brown | 439/149 |
| 2,549,647 | A | 4/1951 | Turenne | |
| 3,076,168 | A | 1/1963 | Keen | |
| 3,184,706 | A | 5/1965 | Atkins | |
| 3,275,913 | A | 9/1966 | Blanchard et al. | |
| 3,292,136 | A | 12/1966 | Somerset | |
| 3,350,677 | A | 10/1967 | Daum | |
| 3,355,698 | A | 11/1967 | Keller | |
| 3,373,243 | A | 3/1968 | Janowiak et al. | |
| 3,406,373 | A | 10/1968 | Forney, Jr. | |
| 3,448,430 | A | 6/1969 | Kelly | |
| 3,475,545 | A | 10/1969 | Stark et al. | |
| 3,498,647 | A | 3/1970 | Schroder | |
| 3,517,373 | A | 6/1970 | Jamon | |

(Continued)

FOREIGN PATENT DOCUMENTS

DE 47931 10/1888

(Continued)

OTHER PUBLICATIONS

Sell Sheet from Stirling; www.StirlingUSA.com; Reader Service No. 109; regarding SPL-6-RTQ 3-In-One RTQ Connectors.

(Continued)

*Primary Examiner*—Felix O. Figueroa
(74) *Attorney, Agent, or Firm*—Hoffmann & Baron, LLP

(57) ABSTRACT

A coaxial cable connector including an annular post defining an axial bore therein, a cylindrical collar movably coupled to the post and a nut rotatably coupled to the post. The post has a shoulder portion defined by an outer surface and a tubular extension extending axially rearwardly from the shoulder portion and the collar has a forward end movably coupled to the outer surface of the post shoulder portion. The collar may also be movably coupled to a rearward interior surface of the rotatable nut in a first position and movable forward to a second position, wherein the collar is coupled to the outer surface of the annular post.

20 Claims, 14 Drawing Sheets

U.S. PATENT DOCUMENTS

| | | | | |
|---|---|---|---|---|
| 3,533,051 | A | | 10/1970 | Ziegler, Jr. |
| 3,537,065 | A | | 10/1970 | Winston |
| 3,544,705 | A | | 12/1970 | Winston |
| 3,564,487 | A | | 2/1971 | Upstone et al. |
| 3,629,792 | A | | 12/1971 | Dorrell |
| 3,633,150 | A | | 1/1972 | Swartz |
| 3,668,612 | A | | 6/1972 | Nepovim |
| 3,671,922 | A | | 6/1972 | Zerlin et al. |
| 3,694,792 | A | | 9/1972 | Wallo |
| 3,710,005 | A | | 1/1973 | French |
| 3,778,535 | A | | 12/1973 | Forney, Jr. |
| 3,781,762 | A | | 12/1973 | Quackenbush |
| 3,836,700 | A | | 9/1974 | Niemeyer |
| 3,845,453 | A | | 10/1974 | Hemmer |
| 3,846,738 | A | | 11/1974 | Nepovim |
| 3,854,003 | A | | 12/1974 | Duret |
| 3,879,102 | A | | 4/1975 | Horak |
| 3,907,399 | A | | 9/1975 | Spinner |
| 3,910,673 | A | | 10/1975 | Stokes |
| 3,915,539 | A | | 10/1975 | Collins |
| 3,936,132 | A | | 2/1976 | Hutter |
| 3,963,320 | A | | 6/1976 | Spinner |
| 3,976,352 | A | | 8/1976 | Spinner |
| 3,980,805 | A | | 9/1976 | Lipari |
| 3,985,418 | A | | 10/1976 | Spinner |
| 4,046,451 | A | | 9/1977 | Juds et al. |
| 4,053,200 | A | | 10/1977 | Pugner |
| 4,059,330 | A | | 11/1977 | Shirey |
| 4,093,335 | A | | 6/1978 | Schwartz et al. |
| 4,126,372 | A | | 11/1978 | Hashimoto et al. |
| 4,131,332 | A | | 12/1978 | Hogendobler et al. |
| 4,150,250 | A | | 4/1979 | Lundeberg |
| 4,156,554 | A | | 5/1979 | Aujla |
| 4,165,554 | A | | 8/1979 | Faget |
| 4,168,921 | A | | 9/1979 | Blanchard |
| 4,225,162 | A | | 9/1980 | Dola |
| 4,227,765 | A | | 10/1980 | Neumann et al. |
| 4,250,348 | A | | 2/1981 | Kitagawa |
| 4,280,749 | A | | 7/1981 | Henuner |
| 4,339,166 | A | | 7/1982 | Dayton |
| 4,346,958 | A | | 8/1982 | Blanchard |
| 4,354,721 | A | | 10/1982 | Luzzi |
| 4,373,767 | A | | 2/1983 | Cairns |
| 4,400,050 | A | | 8/1983 | Hayward et al. |
| 4,408,821 | A | | 10/1983 | Forney, Jr. |
| 4,408,822 | A | | 10/1983 | Nikitas |
| 4,421,377 | A | | 12/1983 | Spinner |
| 4,444,453 | A | * | 4/1984 | Kirby et al. ..... 439/583 |
| 4,456,323 | A | | 6/1984 | Pitcher et al. |
| 4,484,792 | A | | 11/1984 | Tengler et al. |
| 4,515,427 | A | | 5/1985 | Smit |
| 4,533,191 | A | | 8/1985 | Blackwood |
| 4,540,231 | A | | 9/1985 | Forney, Jr. |
| 4,545,637 | A | | 10/1985 | Bosshard et al. |
| 4,575,274 | A | | 3/1986 | Hayward et al. |
| 4,583,811 | A | | 4/1986 | McMills |
| 4,593,964 | A | | 6/1986 | Forney, Jr. et al. |
| 4,596,434 | A | | 6/1986 | Saba et al. |
| 4,596,435 | A | | 6/1986 | Bickford |
| 4,598,961 | A | | 7/1986 | Cohen |
| 4,600,263 | A | | 7/1986 | DeChamp et al. |
| 4,614,390 | A | | 9/1986 | Baker |
| 4,632,487 | A | | 12/1986 | Wargula |
| 4,640,572 | A | | 2/1987 | Conlon |
| 4,645,281 | A | | 2/1987 | Burger |
| 4,650,228 | A | | 3/1987 | McMills et al. |
| 4,655,159 | A | | 4/1987 | McMills |
| 4,660,921 | A | | 4/1987 | Hauver |
| 4,666,229 | A | | 5/1987 | Grand |
| 4,668,043 | A | | 5/1987 | Saba et al. |
| 4,674,818 | A | | 6/1987 | McMills et al. |
| 4,676,577 | A | | 6/1987 | Szegda |
| 4,682,832 | A | | 7/1987 | Punako et al. |
| 4,688,876 | A | | 8/1987 | Morelli |
| 4,688,878 | A | | 8/1987 | Cohen et al. |
| 4,691,976 | A | | 9/1987 | Cowen |
| 4,703,987 | A | | 11/1987 | Gallusser et al. |
| 4,717,355 | A | | 1/1988 | Mattis |
| 4,738,009 | A | | 4/1988 | Down et al. |
| 4,746,305 | A | | 5/1988 | Nomura |
| 4,747,786 | A | | 5/1988 | Hayashi et al. |
| 4,755,152 | A | | 7/1988 | Elliot et al. |
| 4,761,146 | A | | 8/1988 | Sohoel |
| 4,772,222 | A | | 9/1988 | Laudig et al. |
| 4,789,355 | A | | 12/1988 | Lee |
| 4,806,116 | A | | 2/1989 | Ackerman |
| 4,813,886 | A | | 3/1989 | Roos et al. |
| 4,834,675 | A | | 5/1989 | Samchisen |
| 4,854,893 | A | | 8/1989 | Morris |
| 4,857,014 | A | | 8/1989 | Alf et al. |
| 4,869,679 | A | | 9/1989 | Szegda |
| 4,874,331 | A | | 10/1989 | Iverson |
| 4,892,275 | A | | 1/1990 | Szegda |
| 4,902,246 | A | * | 2/1990 | Samchisen ..... 439/578 |
| 4,906,207 | A | | 3/1990 | Banning et al. |
| 4,923,412 | A | | 5/1990 | Morris |
| 4,925,403 | A | | 5/1990 | Zorzy |
| 4,927,385 | A | | 5/1990 | Cheng |
| 4,929,188 | A | | 5/1990 | Lionetto et al. |
| 4,952,174 | A | | 8/1990 | Sucht et al. |
| 4,957,456 | A | | 9/1990 | Olson et al. |
| 4,973,265 | A | | 11/1990 | Heeren |
| 4,979,911 | A | | 12/1990 | Spencer |
| 4,990,104 | A | | 2/1991 | Schieferly |
| 4,990,105 | A | | 2/1991 | Karlovich |
| 4,990,106 | A | | 2/1991 | Szegda |
| 5,002,503 | A | | 3/1991 | Campbell et al. |
| 5,007,861 | A | | 4/1991 | Stirling |
| 5,021,010 | A | | 6/1991 | Wright |
| 5,024,606 | A | | 6/1991 | Ming-Hwa |
| 5,037,328 | A | | 8/1991 | Karlovich |
| 5,062,804 | A | | 11/1991 | Jamet et al. |
| 5,066,248 | A | | 11/1991 | Gaver, Jr. et al. |
| 5,073,129 | A | | 12/1991 | Szegda |
| 5,083,943 | A | | 1/1992 | Tarrant |
| 5,120,260 | A | | 6/1992 | Jackson |
| 5,127,853 | A | | 7/1992 | McMills et al. |
| 5,131,862 | A | | 7/1992 | Gershfeld |
| 5,141,451 | A | | 8/1992 | Down |
| 5,161,993 | A | | 11/1992 | Leibfried, Jr. |
| 5,181,161 | A | | 1/1993 | Hirose et al. |
| 5,195,906 | A | | 3/1993 | Szegda |
| 5,205,761 | A | | 4/1993 | Nilsson |
| 5,207,602 | A | | 5/1993 | McMills et al. |
| 5,217,391 | A | | 6/1993 | Fisher, Jr. |
| 5,217,393 | A | | 6/1993 | Del Negro et al. |
| 5,269,701 | A | | 12/1993 | Leibfried, Jr. |
| 5,283,853 | A | | 2/1994 | Szegda |
| 5,284,449 | A | | 2/1994 | Vaccaro |
| 5,295,864 | A | | 3/1994 | Birch et al. |
| 5,316,494 | A | | 5/1994 | Flanagan et al. |
| 5,338,225 | A | | 8/1994 | Jacobsen et al. |
| 5,342,218 | A | | 8/1994 | McMills et al. |
| 5,354,217 | A | | 10/1994 | Gabel et al. |
| 5,371,819 | A | | 12/1994 | Szegda |
| 5,371,821 | A | | 12/1994 | Szegda |
| 5,371,827 | A | | 12/1994 | Szegda |
| 5,393,244 | A | | 2/1995 | Szegda |
| 5,431,583 | A | | 7/1995 | Szegda |
| 5,435,745 | A | | 7/1995 | Booth |
| 5,444,810 | A | | 8/1995 | Szegda |
| 5,455,548 | A | | 10/1995 | Grandchamp et al. |
| 5,456,611 | A | | 10/1995 | Henry et al. |
| 5,456,614 | A | | 10/1995 | Szegda |

| | | | | |
|---|---|---|---|---|
| 5,466,173 | A | 11/1995 | Down | |
| 5,470,257 | A * | 11/1995 | Szegda | 439/578 |
| 5,494,454 | A | 2/1996 | Johnsen | |
| 5,501,616 | A | 3/1996 | Holliday | |
| 5,525,076 | A | 6/1996 | Down | |
| 5,542,861 | A | 8/1996 | Anhalt et al. | |
| 5,548,088 | A | 8/1996 | Gray et al. | |
| 5,571,028 | A | 11/1996 | Szegda | |
| 5,586,910 | A | 12/1996 | Del Negro et al. | |
| 5,598,132 | A | 1/1997 | Stabile | |
| 5,607,325 | A | 3/1997 | Toma | |
| 5,620,339 | A | 4/1997 | Gray et al. | |
| 5,632,651 | A | 5/1997 | Szegda | |
| 5,651,699 | A | 7/1997 | Holliday | |
| 5,667,405 | A | 9/1997 | Holliday | |
| 5,863,220 | A | 1/1999 | Holliday | |
| 5,879,191 | A | 3/1999 | Burris | |
| 5,967,852 | A | 10/1999 | Follingstad et al. | |
| 5,975,951 | A | 11/1999 | Burris et al. | |
| 5,997,350 | A | 12/1999 | Burris et al. | |
| 6,032,358 | A * | 3/2000 | Wild | 439/583 |
| 6,089,913 | A | 7/2000 | Holliday | |
| 6,146,197 | A | 11/2000 | Holliday et al. | |
| 6,210,222 | B1 * | 4/2001 | Langham et al. | 439/583 |
| 6,217,383 | B1 | 4/2001 | Holland et al. | |
| 6,241,553 | B1 | 6/2001 | Hsia | |
| 6,261,126 | B1 * | 7/2001 | Stirling | 439/583 |
| D458,904 | S | 6/2002 | Montera | |
| D460,739 | S | 7/2002 | Fox | |
| D460,740 | S | 7/2002 | Montera | |
| D460,946 | S | 7/2002 | Montena | |
| D460,947 | S | 7/2002 | Montena | |
| D460,948 | S | 7/2002 | Montena | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| D468,696 | S | 1/2003 | Montena | |
| 6,530,807 | B2 | 3/2003 | Rodrigues et al. | |
| 6,558,194 | B2 | 5/2003 | Montena | |
| 6,805,584 | B1 * | 10/2004 | Chen | 439/578 |
| 6,817,896 | B2 | 11/2004 | Deventhal | |
| 6,848,940 | B2 | 2/2005 | Montena | |
| 2004/0102089 | A1 * | 5/2004 | Chee | 439/578 |
| 2004/0229504 | A1 * | 11/2004 | Liu | 439/578 |
| 2005/0208827 | A1 * | 9/2005 | Burris et al. | 439/578 |

FOREIGN PATENT DOCUMENTS

| | | |
|---|---|---|
| DE | 102289 | 7/1897 |
| DE | 1117687 | 11/1961 |
| DE | 1 515 398 | 11/1962 |
| DE | 1 191 880 | 4/1965 |
| DE | 2 221 936 | 5/1972 |
| DE | 2 225 764 | 5/1972 |
| DE | 2 261 973 | 12/1972 |
| DE | 32 11 008 A1 | 10/1983 |
| EP | 0 072 104 B1 | 2/1983 |
| EP | 0 116 157 A1 | 8/1984 |
| EP | 0 167 738 A2 | 1/1986 |
| EP | 0 265 276 B1 | 4/1988 |
| FR | 2 232 846 | 6/1973 |
| FR | 2 234 680 | 6/1974 |
| FR | 2 462 798 | 2/1981 |
| GB | 589697 | 3/1945 |
| GB | 1087228 | 10/1967 |
| GB | 1 270 846 | 4/1972 |
| GB | 2019 665 A | 10/1979 |
| GB | 2 079 549 A | 1/1982 |
| GB | 2079 549 A | 1/1982 |
| WO | 93/24973 | 12/1993 |
| WO | 96/08854 | 3/1996 |
| WO | WO 01/86756 | 11/2001 |

OTHER PUBLICATIONS

Sell Sheet from PCT International; Reader Service No. 133; regarding DRS Compression Connectors—description/features and benefits.

* cited by examiner

COAXIAL CABLE CONNECTOR

CROSS-REFERENCE TO RELATED APPLICATIONS

This application claims the benefit of U.S. Provisional Application No. 60/562,953, filed on Apr. 16, 2004, and U.S. Provisional Application No. 60/562,952, filed on Apr. 16, 2004.

FIELD OF THE INVENTION

The present invention relates generally to connectors for terminating coaxial cable. More particularly, the present invention relates to a coaxial cable connector having fewer connector components and providing simpler installation.

BACKGROUND OF THE INVENTION

It has long been known to use connectors to terminate coaxial cable so as to connect a cable to various electronic devices such as televisions, radios and the like.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Such a prepared cable may be terminated in a conventional coaxial connector.

Prior art coaxial connectors generally include a connector body having an annular collar for accommodating a coaxial cable, an annular nut rotatably coupled to the collar for providing mechanical attachment of the connector to an external device and an annular post interposed between the collar and the nut. Upon assembly to a coaxial cable, the annular post is inserted between the foil covered insulator and the conductive shield of the cable. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further includes a locking sleeve to secure the cable within the body of the coaxial connector. The locking sleeve, which is typically formed of a resilient plastic, is securable to the connector body to secure the coaxial connector thereto. Thus, the prior art coaxial cable connector included four distinct components: a rotatable nut; a connector body; an annular post; and a locking sleeve. A coaxial cable connector of this type is shown and described in commonly owned U.S. Pat. No. 6,530,807.

Such coaxial connectors are generally manufactured in large quantities at relatively low costs. One cost factor in manufacturing these connectors is the number of connector components that are required for assembly. Thus, eliminating just one component of the connector could significantly reduce the connector's manufacturing cost. Furthermore, fewer components could also simplify the cable installation process.

It is, therefore, desirable to provide a coaxial connector having fewer components. In particular, it would be desirable to provide a coaxial connector that eliminates the need for a locking sleeve altogether. As a result, the number of components of the connector would be reduced, along with the connector's associated manufacturing costs, and the cable installation process would be simplified.

OBJECTS AND SUMMARY OF THE INVENTION

It is an object of the present invention to provide a coaxial cable connector for terminating a coaxial cable.

It is a further object of the present invention to provide a coaxial cable connector having fewer components and, therefore, a lower manufacturing cost.

It is a further object of the present invention to simplify the cable installation process.

It is another object of the present invention to provide a method of terminating a coaxial cable.

In the efficient attainment of these and other objects, the present invention provides a coaxial cable connector. The connector of the present invention generally includes an annular post defining an axial bore therein, a cylindrical collar movably coupled to the post and a nut rotatably coupled to the post. The post has a shoulder portion defined by an outer surface and a tubular extension extending axially rearwardly from the shoulder portion and the collar has a forward end movably coupled to the outer surface of the post shoulder portion.

In a preferred embodiment, the collar and the post tubular extension define an annular chamber therebetween. The post may further include an annular sleeve portion extending rearwardly from the shoulder portion, which, together with the tubular extension, defines an annular pocket therebetween. The connector further preferably includes a sealing ring disposed between the post, the collar and the nut to provide a water resistant seal thereat. Also, the post shoulder portion preferably includes a flanged base portion for securing the post in the nut.

For coupling the collar to the post, the outer surface of the post shoulder portion and the forward end of the collar preferably include cooperating detent structure for permitting axial movable connection of the collar and the post. This cooperating detent structure preferably includes an annular rib formed on one of the forward end of the collar and the outer surface of the post shoulder portion and two axially spaced annular grooves formed on the other of the forward end of the collar and the outer surface of the post shoulder portion. The annular rib may be provided on the collar and is preferably defined by a rearwardly facing perpendicular wall and a forwardly facing chamfered wall. In this case, the grooves are provided on the outer surface of the post shoulder portion and are defined by a forwardly facing perpendicular wall and a rearwardly facing chamfered wall to permit only forward movement of the collar on the post from a first position for loosely retaining a coaxial cable within the connector to a forward second position for securing the cable within the connector.

In alternative embodiments, the forward end of the collar may be press-fit on the outer surface of the post shoulder portion, or it may be threadably engaged with the outer surface of the post shoulder portion. In any event, the post shoulder portion preferably includes a rearwardly facing chamfered wall at a transition between the shoulder portion and the tubular extension to facilitate attachment of the collar to the post.

In other alternative embodiments, the collar may be detachably coupled to the post. Additionally, the collar may include a detachable arm extending outwardly therefrom for temporarily attaching the collar to the post in an initial configuration. The detachable arm may include a ring extension extending radially outwardly from the collar and a ring disposed at an end of the ring extension for attaching the collar to the post, wherein the ring is sized to be snugly fit on the outer surface of the post shoulder portion. The ring may include a slot breaking the continuity of the ring for facilitating perpendicular attachment of the ring to the post shoulder portion and the ring extension may include a frangible portion disposed where the extension meets the collar. Moreover, the outer surface of the post shoulder portion and the ring may include cooperating detent structure for facilitating attachment of the ring to the post shoulder portion.

In still another alternative embodiment, the collar is movably coupled to a rearward interior surface of the rotatable nut in a first position and is movable forward to a second position, wherein the collar is coupled to the outer surface of the annular post. Here too, cooperating detent structure may be provided to facilitate forward movable connection of the collar and the post. Specifically, the detent structure preferably includes an outwardly extending annular rib formed on an outer surface of the forward end of the collar, an inwardly extending annular rib formed on an inner surface of the forward end of the collar, a first annular groove formed on the inner surface of the nut and a second annular groove formed on the outer surface of the post shoulder portion.

The present invention further involves a method for terminating a coaxial cable within a coaxial cable connector. The method generally includes the steps of inserting a prepared end of a coaxial cable into a rearward end of a cylindrical collar of the connector having a forward end movably coupled to an outer surface of an annular post of the connector and moving the collar forward on the outer surface of the annular post to a locked position wherein the cable is secured within the connector.

In a preferred embodiment of the method, during the moving step, the cable end is compressed within an annular chamber formed between the collar and a tubular extension of the post extending axially rearward from the shoulder portion. Also, the moving step preferably involves moving the collar from a first position wherein the cable is loosely retained within the connector to the locked position wherein the cable is secured within the connector. The moving step further preferably includes the step of disengaging a rib formed on one of the forward end of the collar and the outer surface of the annular post from a first groove formed on the other of the forward end of the collar and the outer surface of the annular post and engaging the rib in a second groove formed on the other of the forward end of the collar and the outer surface of the annular post.

The method may further include the steps of detaching an arm of the collar from the outer surface of the annular post, detaching the arm from the collar and movably coupling the forward end of the collar to the outer surface of the annular post. The inserting step may also include the step of inserting a shield portion of the prepared end of the coaxial cable into an annular pocket defined between an annular sleeve portion and a tubular extension of the annular post.

In an alternative embodiment, the prepared end of a coaxial cable is inserted into a rearward end of a cylindrical collar of the connector that is initially apart from the annular post. The collar is then movably coupling to an outer surface of the annular post and moved forward on the outer surface of the annular post to a locked position wherein the cable is compressed between the inside of the collar and the outside of the post thereby locking the cable to the connector.

Thus, the connector may be supplied in a configuration wherein the movable collar is initially temporarily attached to the post by a detachable arm. In this case, the user would first detach the collar from the post and then frangibly detach the arm from the collar. The collar would then be attachable to the post in its installation position for receiving a coaxial cable.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

The present invention is directed to connectors for terminating coaxial cable. Coaxial connectors of this type are shown and described in commonly owned U.S. Pat. No. 6,530,807 issued Aug. 28, 2003, the disclosure of which is incorporated herein by reference.

Figure 1:
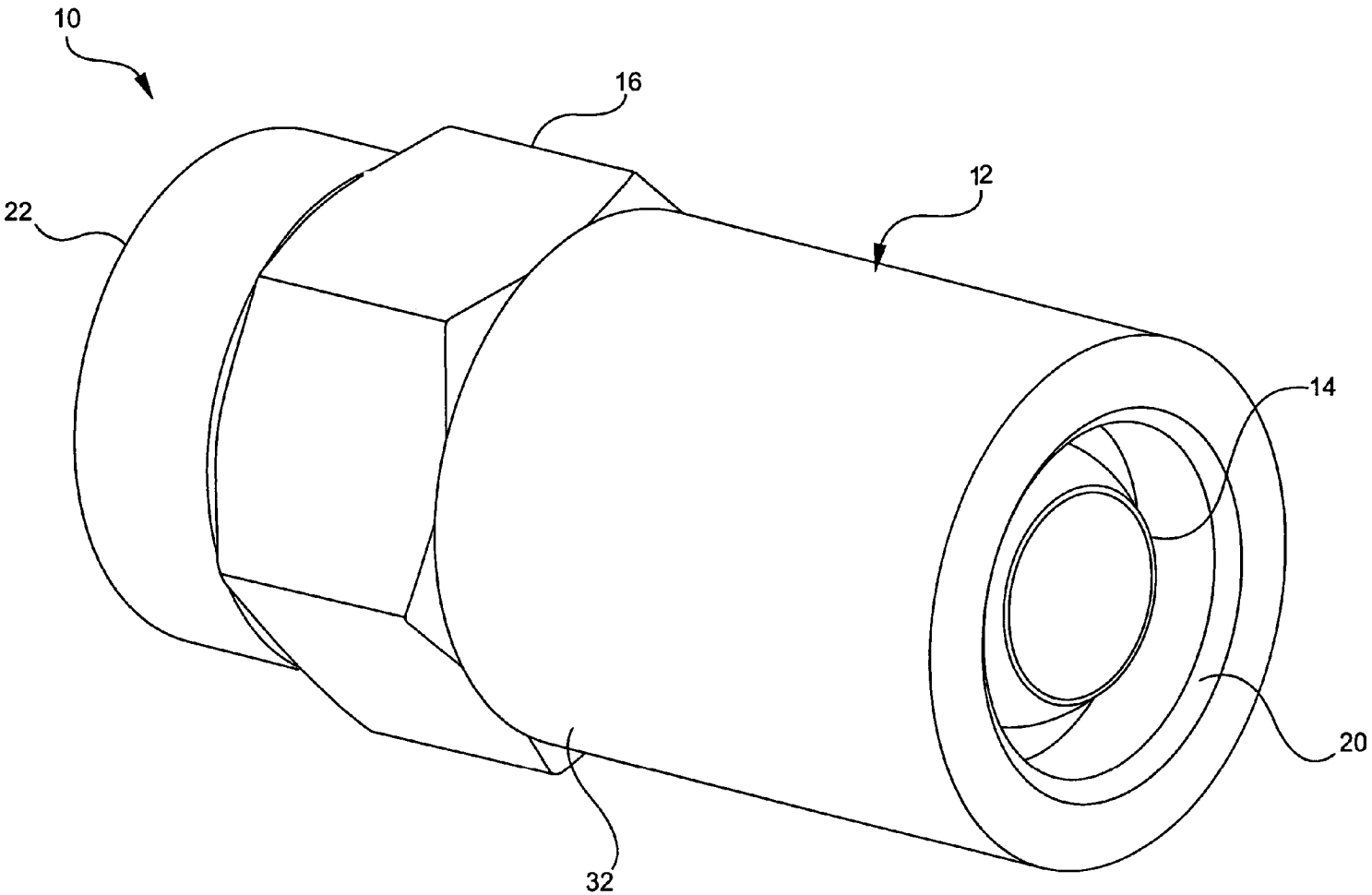
FIG. 1 is a perspective view of the coaxial cable connector of the present invention including a connector body having a movable collar, a post and a nut.
Figure 2:
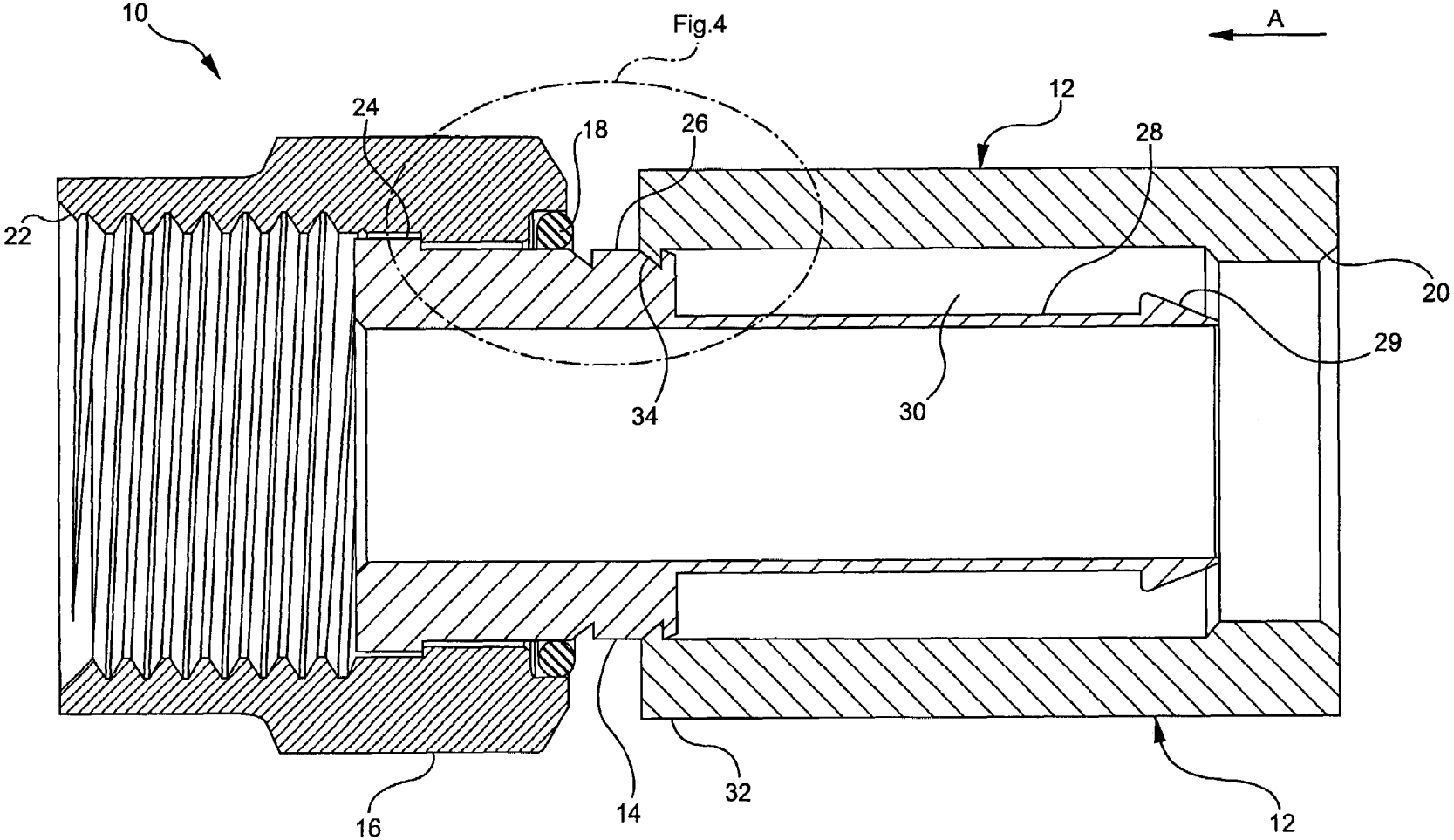
FIG. 2 is a cross-sectional view of the connector shown in FIG. 1 with the movable collar in its first open position.
Figure 3:
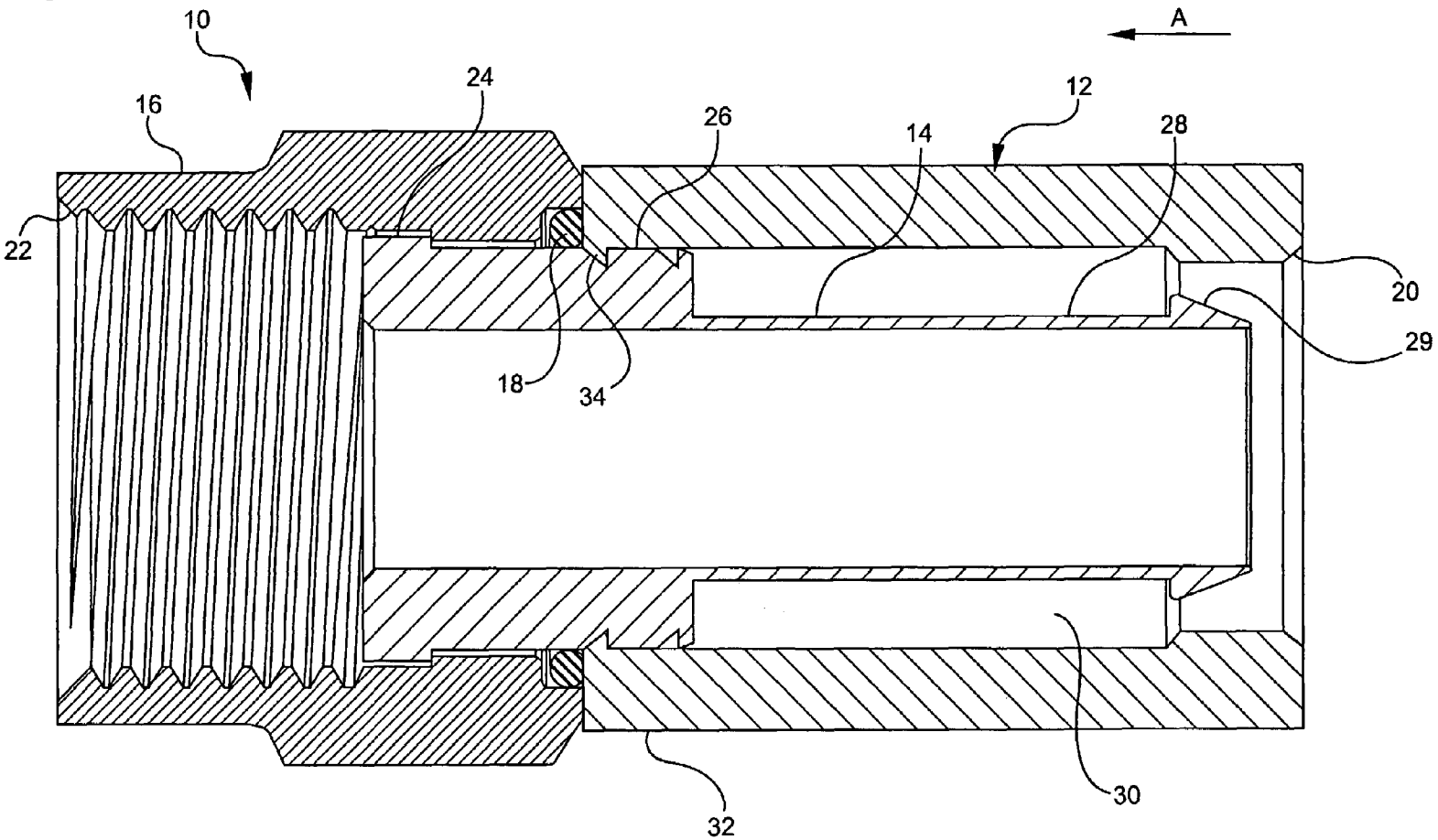
FIG. 3 is a cross-sectional view of the connector shown in FIG. 1 with the movable collar in its second closed position.

Referring to FIGS. 1-3, the coaxial cable connector 10 of the present invention is shown. Contrary to the prior art connectors, connector 10 includes only three components: a movable collar 12; an annular post 14; and a rotatable nut 16. The collar 12 is an elongate generally cylindrical member, which may be formed of metal or plastic, having one end movably coupled to the post 14 and an opposite end for receiving a coaxial cable. The nut 16 may be in any form, such as a hex nut, knurled nut, wing nut, etc., and is rotatably coupled to the post 14 for providing mechanical attachment of the connector to an external device. A resilient sealing O-ring 18 may be positioned between the collar 12, the post 14 and the nut 16 at the rotatable juncture thereof to provide a water resistant seal thereat.

The collar 12 includes a cable receiving end 20 for insertably receiving a prepared end of a coaxial cable. The nut 16 includes an internally threaded end extent 22 permitting screw threaded attachment of the connector body 10 to the external device. The cable receiving end 20 and the internally threaded end extension 22 define opposite ends of the connector 10.

The annular post 14 includes a flanged base portion 24, which provides for press-fit securement of the post within a post receiving space in the nut 16. The annular post 14 further includes an elongated annular shoulder portion 26 having an outer surface which provides for movable attachment of the collar 12 to the post. The post 14 also includes an annular tubular extension 28 extending into the collar. The distal end of the tubular extension 28 includes a radially outwardly extending ramped flange portion 29 for compressing the outer jacket of the coaxial cable between the flange portion 29 and the internal diameter of the collar 12 to secure the cable within the connector. As will be described in further detail hereinbelow, the extension 28 of the post 14 and the collar 12 define an annular chamber 30 for accommodating the jacket and shield of the inserted coaxial cable.

Opposite the cable receiving end 20 of the collar 12 is a forward end 32 which is movably coupled to the outer surface of the shoulder portion 26 of the post 14. As will be described in further detail hereinbelow, the forward end 32 of the collar 12 and the shoulder portion 26 of the post 14 preferably include cooperative detent structure which allows for the movable connection of the collar 12 to the post 14 such that the collar is axially moveable along arrow A of FIGS. 2 and 3, towards nut 16 from a first position shown in FIG. 2, which loosely retains the cable within the connector body 10, to a more forward second position shown in FIG. 3, which secures the cable within the connector.

Figure 3A:
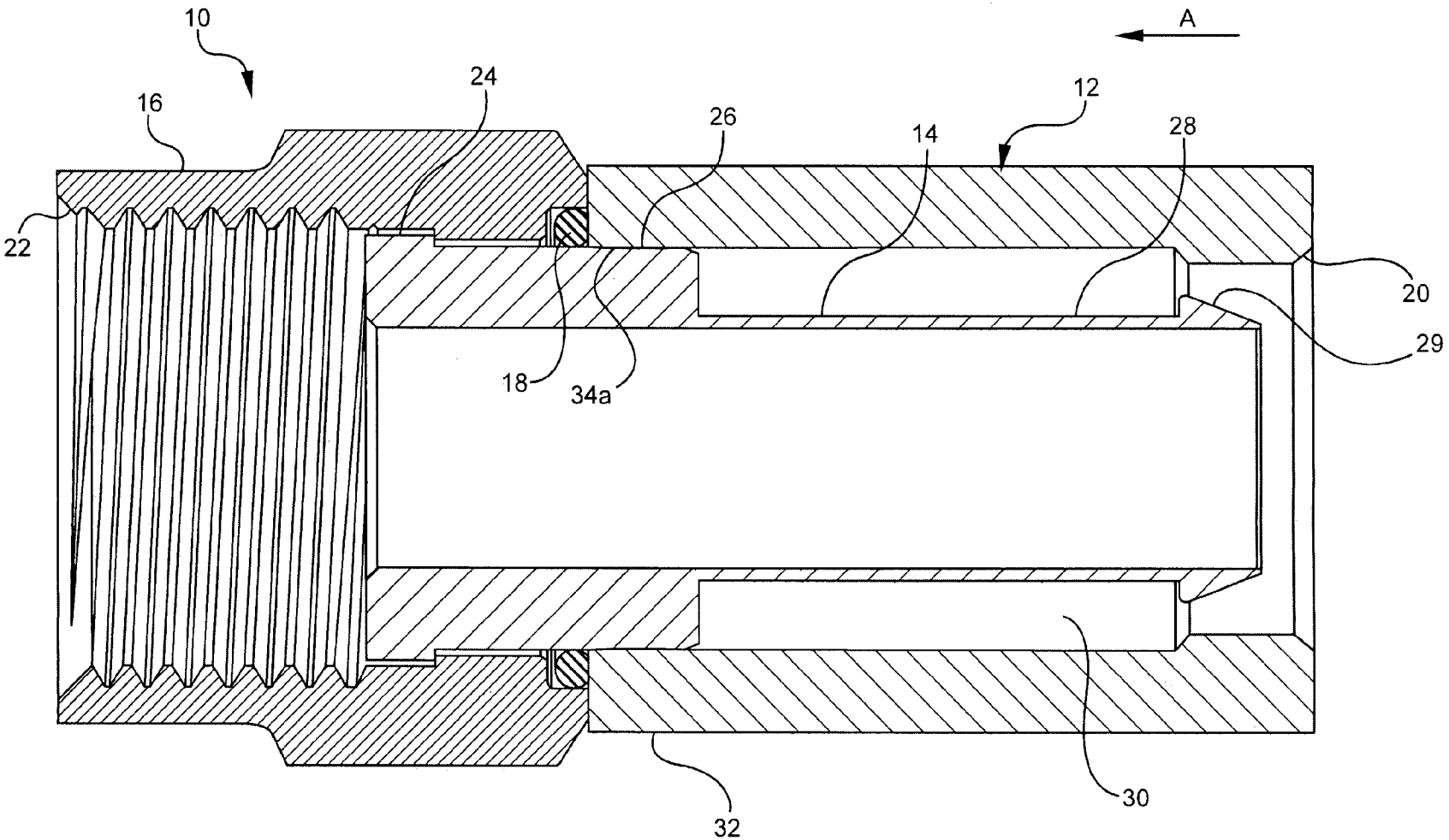
FIG. 3*a* is a cross-sectional view of an alternative embodiment of the connector shown in FIG. 3.
Figure 3B:
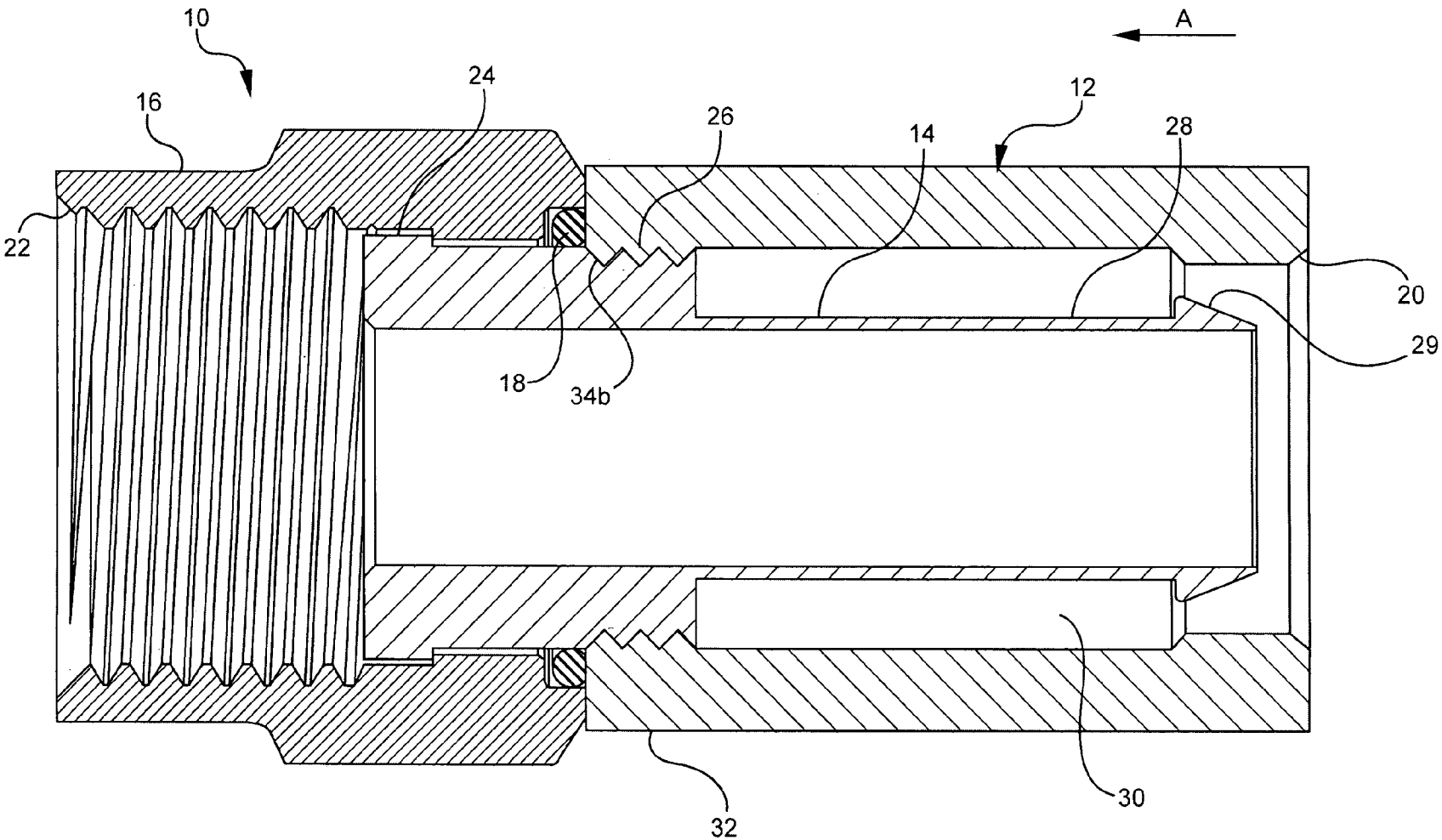
FIG. 3*b* is a cross-sectional view of another alternative embodiment of the connector shown in FIG. 3.

It is envisioned that other types of securing means may be utilized to movably couple the collar 12 to the annular post 14. For example, the collar 12 and the post 14 can be provided with friction-fit structure 34*a*, wherein the forward end 32 of the collar may be press-fit onto the shoulder portion 26 of the post 14, as shown in FIG. 3*a*, and whereby the cable is locked in position by the friction fit between the post 14 and the collar 12 and between the post ramped flange 29 and the collar. Alternatively, the post shoulder portion 26 and the internal diameter of the collar 12 may be provided with mating cooperating threads 34*b*, as shown in FIG. 3*b*, for movably securing the collar to the post 14 between its first and second position.

The connector 10 of the present invention is constructed so as to be supplied in the assembled condition shown in FIG. 2, wherein the collar 12 is attached to the post 14 in its first position. In such assembled condition, and as will be described in further detail hereinbelow, a coaxial cable may be inserted through the rearward end 20 of the collar 12. The collar 12 may then be moved from the first position loosely retaining the cable to the second position which is axially forward thereby locking the cable within the connector.

It is, however, contemplated that the connector 10 may be provided with securing means such that the collar 12 may be detachably coupled to the post 14 and, in a manner which will be described in further detail hereinbelow, will allow the coaxial cable to be first inserted directly into the post 14 unobstructed by the collar. Thereafter, the collar 12, which has been earlier placed around the cable, may be reattached to the post 14 where it can be moved from the first position to the second position locking the cable within the connector.

Figure 4:
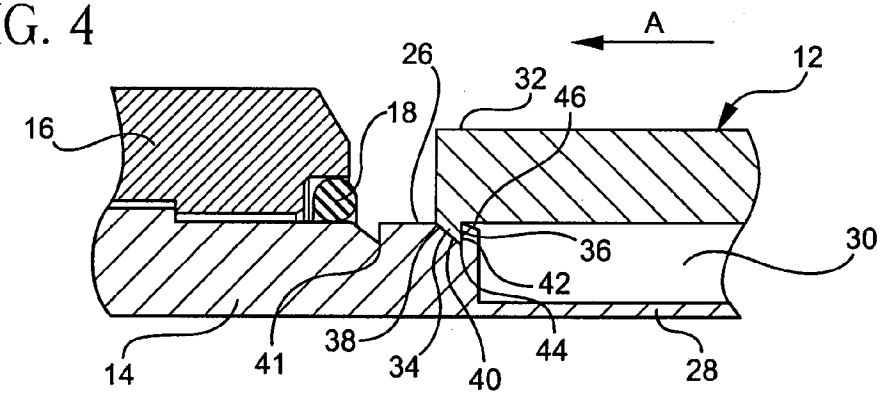
FIG. 4 is a detailed view of the cooperating detent structure shown in FIGS. 2 and 3.

The cooperating detent structure mentioned above is but one exemplary structure employed to provide such attachment and movement of the collar 12 to the post 14. With additional reference to FIG. 4, the cooperating detent structure is shown. Forward end 32 of the collar 12 includes a radially inwardly directed annular rib 34 extending adjacent the distal end thereof. Rib 34 is defined by a rearwardly facing perpendicular wall 36 and a forwardly facing chamfered wall 38. The cooperating detent structure of the present invention further includes the shoulder portion 26 of the post 14 formed to have two radially outwardly opening annular grooves 40 and 41 constructed so as to receive the rib 34 of the collar 12. The grooves 40 and 41 are axially spaced on the shoulder portion 26 of the post to define a rearward groove 40 and a forward groove 41. Both grooves 40 and 41 may include a forwardly facing perpendicular wall 42 and a rearwardly facing chamfered wall 44, which respectively engage the perpendicular wall 36 and the chamfered wall 38 of the collar rib 34. Where it is desired to have the collar 12 detachable from the post 14 when the collar is in its first position, it is preferable to eliminate the perpendicular wall 42 from the rearward groove 40 and substitute a forwardly facing chamfered wall in its place. It is also contemplated to have the cooperating detent structure reversed, wherein an annular rib is provided on the outer surface of the post shoulder portion and a pair of axially spaced grooves are provided on the inner surface of the forward end of the collar.

As may be appreciated, the post 14 may be inserted into the forward end 32 of the collar 12 until the rib 34 of the collar comes to rest within the rearward groove 40 of the post shoulder portion 26. To further facilitate initial assembly of the collar 12 to the post 14, the transition of the post between the shoulder portion 26 and the annular tubular extension 28 may also be provided with a rearwardly facing chamfered wall 46. Upon assembly of the collar 12 to the post 14, the forward chamfered wall 38 of the collar rib 34 bears against the rearward chamfered wall 46 of the post shoulder portion transition. By its tubular shape, the collar 12 will have some resiliency at its forward end 32 which will allow the rib 34 to ride over the rearward chamfered wall 46 of the post shoulder portion 26 until the rib becomes lockingly resident within the rearward groove 40 of the post shoulder portion. This defines the first position of the collar 12.

As mentioned above, the cooperative detent structure of the present invention further includes a radially outwardly extending forward groove 41 formed on the shoulder portion 26 of the post 14 adjacent the rearward groove 40. Upon continued coaxial movement of the collar 12 along arrow A, the rib 34 of the collar disengages the rearward groove 40 and becomes resident within the forward groove 41 to define the second position of the collar which locks the collar in this position, thereby locking the cable within the connector.

Having described the components of the connector 10 in detail, the use of the connector in terminating a coaxial cable may now be described with respect to FIG. 5. Coaxial cable 50 includes an inner conductor 52 formed of copper or similar conductive material. Extending around the inner conductor 52 is an insulator 54 formed of a suitably insulative plastic. A metallic foil 53 is disposed over the insulator 54 and a metallic shield 56 is positioned in surrounding relationship around the foil covered insulator. Covering the metallic shield 56 is an outer insulative jacket 58.

Cable 50 is prepared in conventional fashion for termination by stripping back jacket 58 exposing an extent of shield 56. A portion of the foil covered insulator 54 extends therefrom with an extent of conductor 52 extending from insulator 54. The preparation process includes folding back an end extent of shield 56 about jacket 58.

Figure 5:
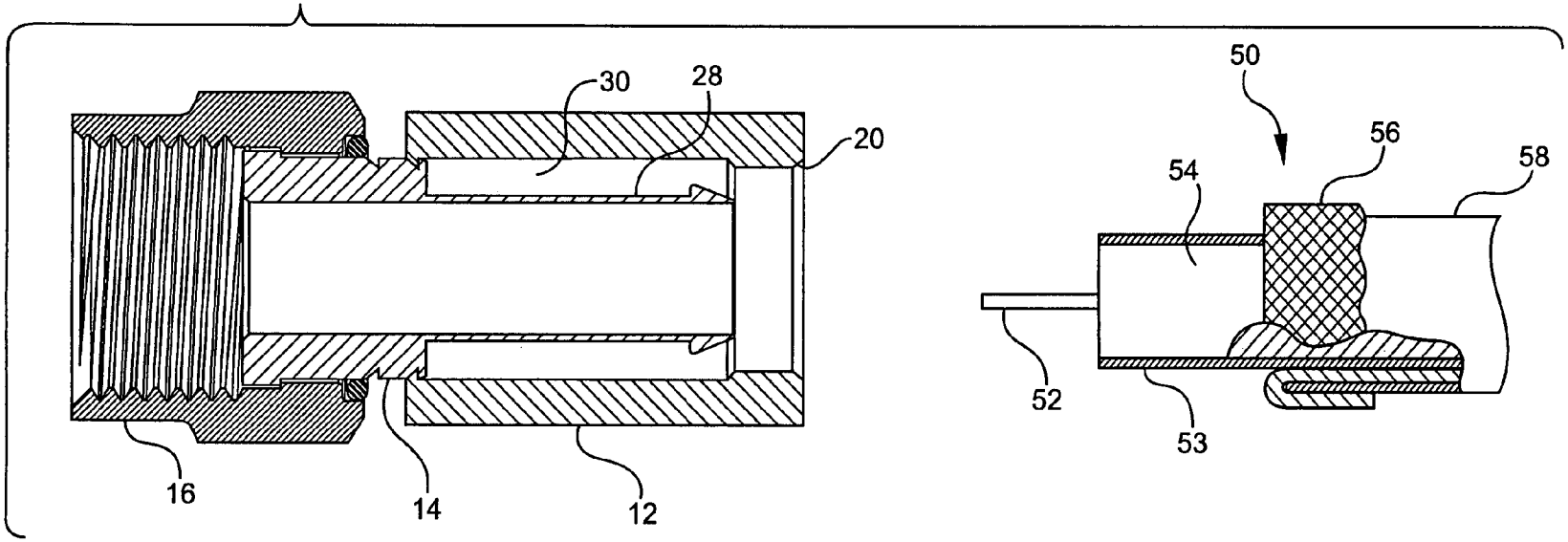
FIG. 5 is an exploded cross-sectional view of the termination of a prepared coaxial cable with the connector of the present invention.

As shown in exploded view in FIG. 5, cable 50 may be inserted into the connector 10 with the collar 12 coupled to the post 14 as shown in FIG. 2. In this technique, the prepared cable 50 is inserted through the rearward end 20 of the collar 12. The extension 28 of the post 14 is inserted between the foil covered insulator 54 and the metallic shield 56 such that the shield and the jacket 58 reside within the annular region 30 defined between the post 14 and the collar 12. When the collar 12 is coupled to the post 14 in the first position, as shown in FIGS. 2 and 5, sufficient clearance is provided between the collar and the post so that extension 28 may be easily interposed between the insulator 54 and the shield 56 of the cable 50.

Once the cable 50 is properly inserted, the collar 12 may be moved axially forward from the first position shown in FIGS. 2 and 5, to the second position shown in FIG. 3. When the collar 12 is moved axially forward, the rib 34 formed in the forward end 32 of the collar 12 disengages the rearward groove 40 formed in the shoulder portion 26 of the post 14. Such movement is facilitated by the forward facing chamfered wall 38 of the collar rib 34 and the cooperating rearward facing chamfered wall 44 of the rearward groove 40. The collar 12 is moved axially forward until the collar rib 34 engages the forward groove 41 formed in the shoulder portion 26 of the post 14. In this second position, the jacket 58 and shield 56 of the cable 50 begins to become compressively clamped within the annular region 30 between the post 14 and the collar 12. The perpendicular walls 36 and 42 of the rib 34 and the forward groove 41 help to maintain the collar 12 in the second position with respect to the post 14. A suitable tool may be used to effect movement of the collar 12 from its first position to its second position securing cable 50 to the connector 10.

As may be appreciated, proper insertion of the cable 50 into the connector body 10 requires that the cable be inserted in such a manner that the extension 28 of the post 14 becomes resident between the foil covered insulator 54 and the shield 56. In certain installation settings, the installer may not have clear and convenient access when terminating the cable 50. Moreover, insertion may be rendered difficult by poor cable preparation, which may result in a frayed end. Therefore, it may be difficult for the installer to blindly insert the cable 50 through the collar 12 and into the connector body 10. In such situations, the present invention contemplates the ability to detachably remove the collar 12 from the post 14 so that the cable may be directly connected to the extension 28 of the post 14.

In these situations, the collar 12 is detachably removed from the post 14 in a manner facilitated as above described. The collar 12 is then slipped over the cable 50 and moved to a convenient position along the cable length. The end of the foil covered insulator 54 may then be inserted directly into the post extension 28 so that the extension is interposed between the foil covered insulator 54 and the shield 56. Thereafter, the collar 12 may be brought up along the cable 50 and the forward end 32 of the collar may be slipped over the shoulder portion 26 of the post 14. The respective chamfered walls 38 and 46 of the collar rib 34 and the shoulder portion transition facilitates insertion of the post 14 into the collar 12 so that the collar rib becomes resident within the rearward groove 40 as shown in FIGS. 2 and 5 defining the first position. Thereafter, as described above, the collar 12 may be moved from the first position shown in FIGS. 2 and 5 to a second position shown in FIG. 3 where the rib 34 becomes resident within the forward groove 41 of the post 14 thereby locking the cable 50 in the connector 10.

Alternatively, the collar 12 may simply be removably press-fit over the post shoulder portion 26 without the use of any detent structure. In this case, the same installation method would apply to secure the coaxial cable within the connector.

Figure 6:
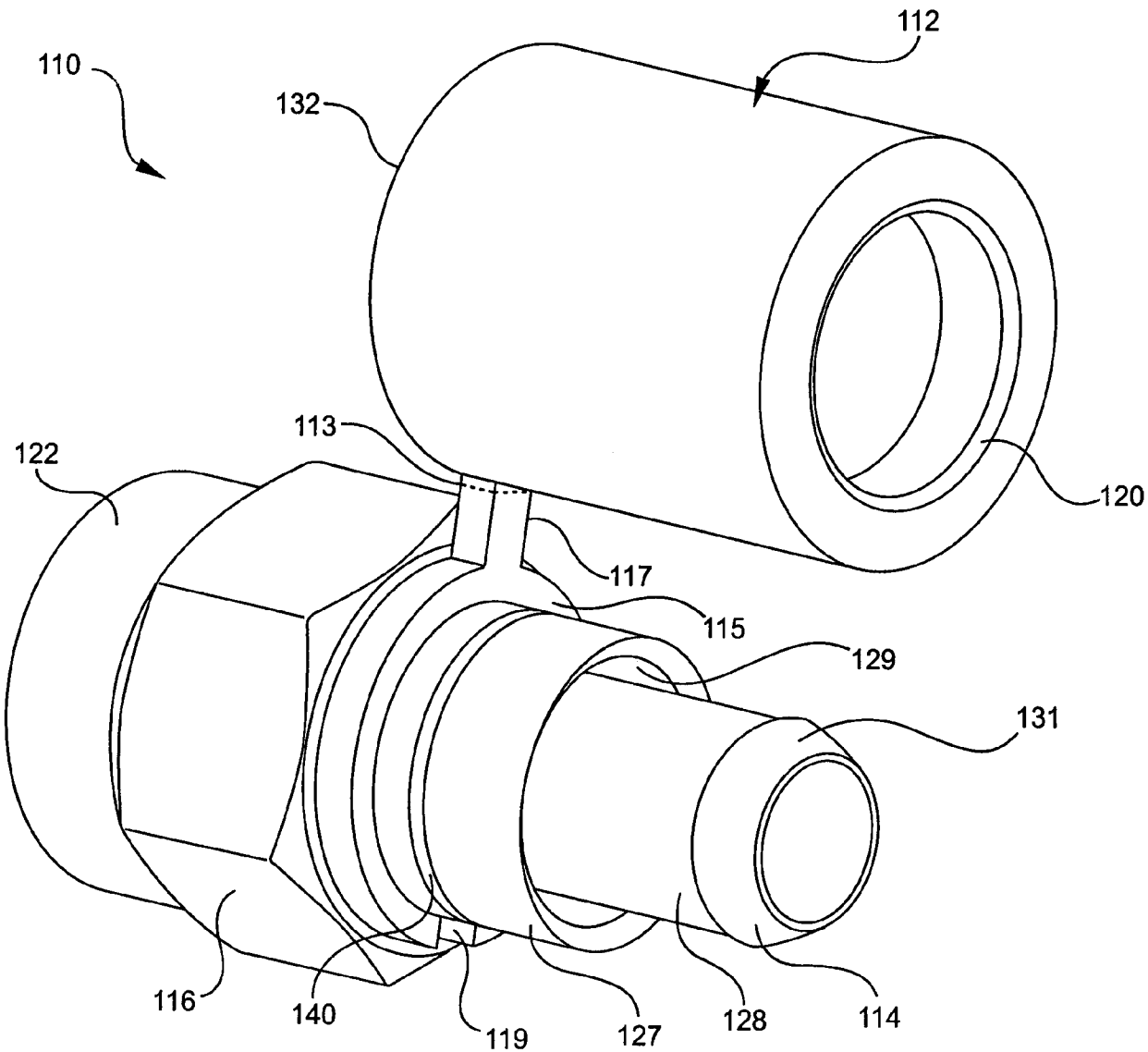
FIG. 6 is a perspective view of an alternative embodiment of the coaxial cable connector of the present invention shown in its initial supplied configuration including a connector body having a movable collar, a post and a nut.
Figure 7:
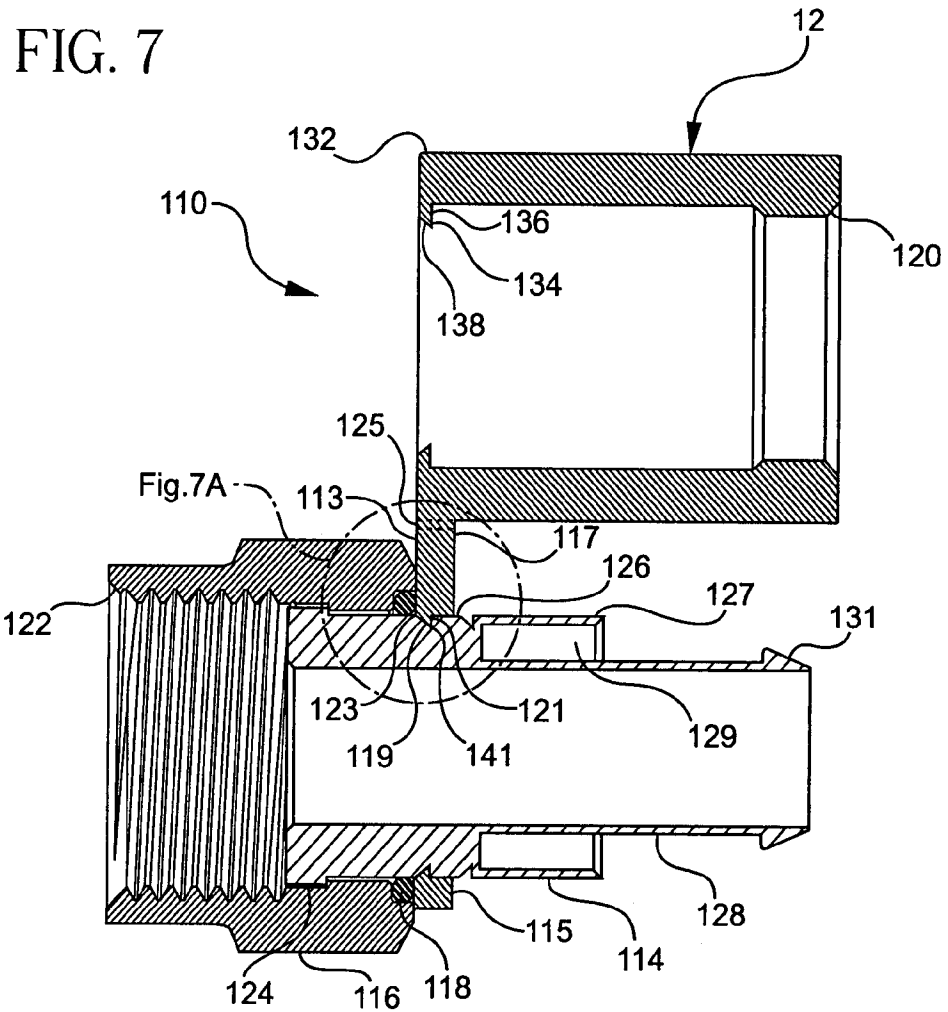
FIG. 7 is a cross-sectional view of the connector shown in FIG. 6.
Figure 7A:
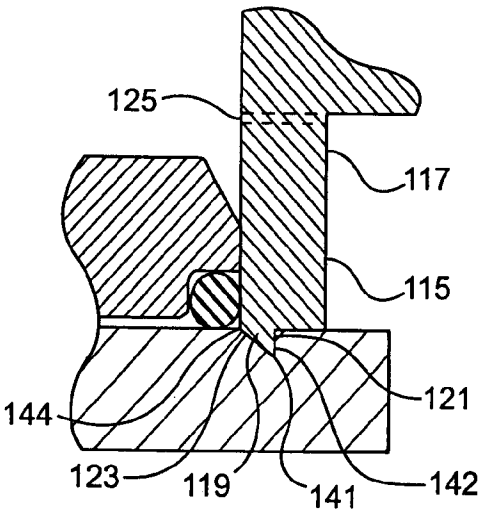
FIG. 7*a* is an enlarged view of the temporary attachment of the collar to the post shown in FIG. 7.

Referring now to FIGS. 6-12, an alternative embodiment 110 of the coaxial cable connector formed in accordance with the present invention is shown. FIGS. 6, 7 and 7*a* show the coaxial cable connector 110 of the alternative embodiment in its initial configuration as supplied to an installer. Connector 110 includes three major components: a movable collar 112; an annular post 114; and a rotatable nut 116. The collar 112 is an elongate generally cylindrical member, which may be formed of metal or plastic, and having one end movably coupled to the post 114 and an opposite end for receiving a coaxial cable. The nut 116 may be in any form, such as a hex nut, knurled nut, wing nut, etc., and is rotatably coupled to the post 114 for providing mechanical attachment of the connector to an external device. A resilient sealing O-ring 118 may be positioned between the collar 112, the post 114 and the nut 116 at the rotatable juncture thereof to provide a water resistant seal thereat.

The collar 112 is initially temporarily attached to the post 114 by a detachable arm 113 including a ring 115 and a ring extension 117. The ring 115 is sized to receive and be snugly fitted over a shoulder portion 126 of the post 114. The ring 115 may take the form of a split-ring wherein a slot 119 breaks the continuity of the ring to facilitate easy attachment and detachment of the collar 112 to the post 114. With a split-ring arrangement, the collar 112 may be attached and detached from the post 114 in a direction perpendicular to the post axis, as opposed to being longitudinally slipped over the post shoulder section.

The ring 115 further preferably includes a radially inwardly directed annular rib 119 defined by a rearwardly facing perpendicular wall 121 and a forwardly facing chamfered wall 123. The rib 119 of the ring 115 engages a radially outwardly opening annular forward groove 141 formed in the shoulder portion 126 of the post 114 to secure the ring to the post. With additional reference to FIG. 10, the forward groove 141 preferably includes a forwardly facing perpendicular wall 142 and a rearwardly facing chamfered wall 144, which respectively engages the perpendicular wall 121 and the chamfered wall 123 of the ring rib 119.

As may be appreciated, the ring 115 may be longitudinally slipped over the post 114 or, where the ring is a split-ring, it may be laterally snapped in place whereby the rib 119 of the ring comes to rest within the forward groove 141 of the post shoulder portion 126. To further facilitate initial assembly of the ring 115 to the post 114, the ring rib 119 is provided with the forward chamfered wall 123 which, when seated, bears against the rearward chamfered wall 144 of the forward groove 141. However, the rearward facing perpendicular wall 121 of the ring rib 119 bearing against the forward facing perpendicular wall 142 of the forward groove 141 prevents inadvertent rearward axial movement of the ring 115.

The ring 115 is connected to the collar 112 by a radially outwardly extending ring extension 117. The ring extension 117 preferably includes a frangible portion 125 disposed where the extension meets the collar 112. The frangible portion 125 may include a perforation, slit, groove or other structure for permitting the ring extension 117 to be easily and cleanly detached from the collar 112. Once detached from the collar 112, the detachable arm 113, including the ring 115 and the ring extension 117, has no further use and may be discarded. The collar 112 is now preferably slipped over the end of a prepared coaxial cable or, alternatively, the collar may be attached first to the post 114.

Figure 8:
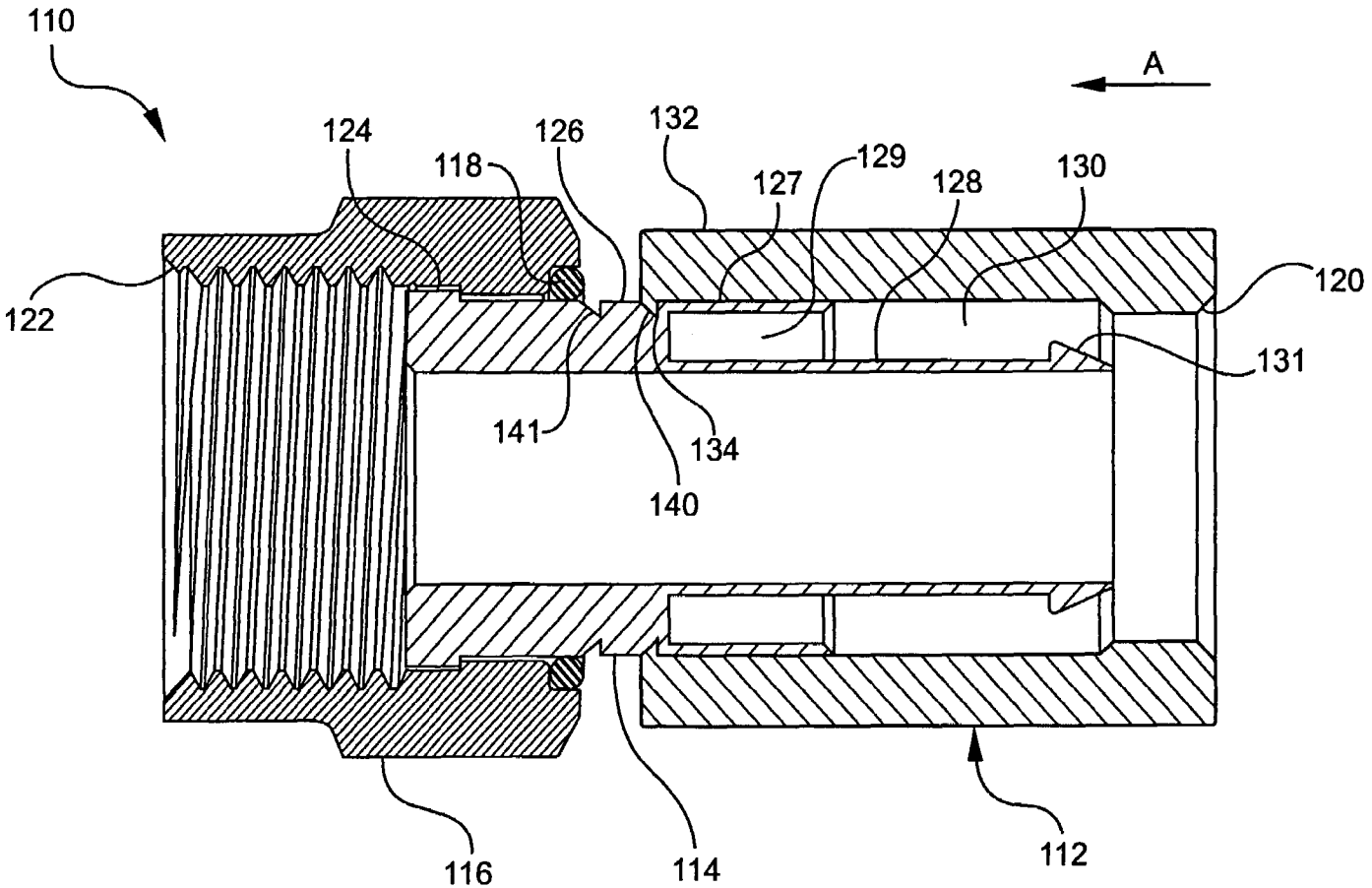
FIG. 8 is a cross-sectional view of the connector shown in FIG. 6 with the movable collar in its first open position.
Figure 9:
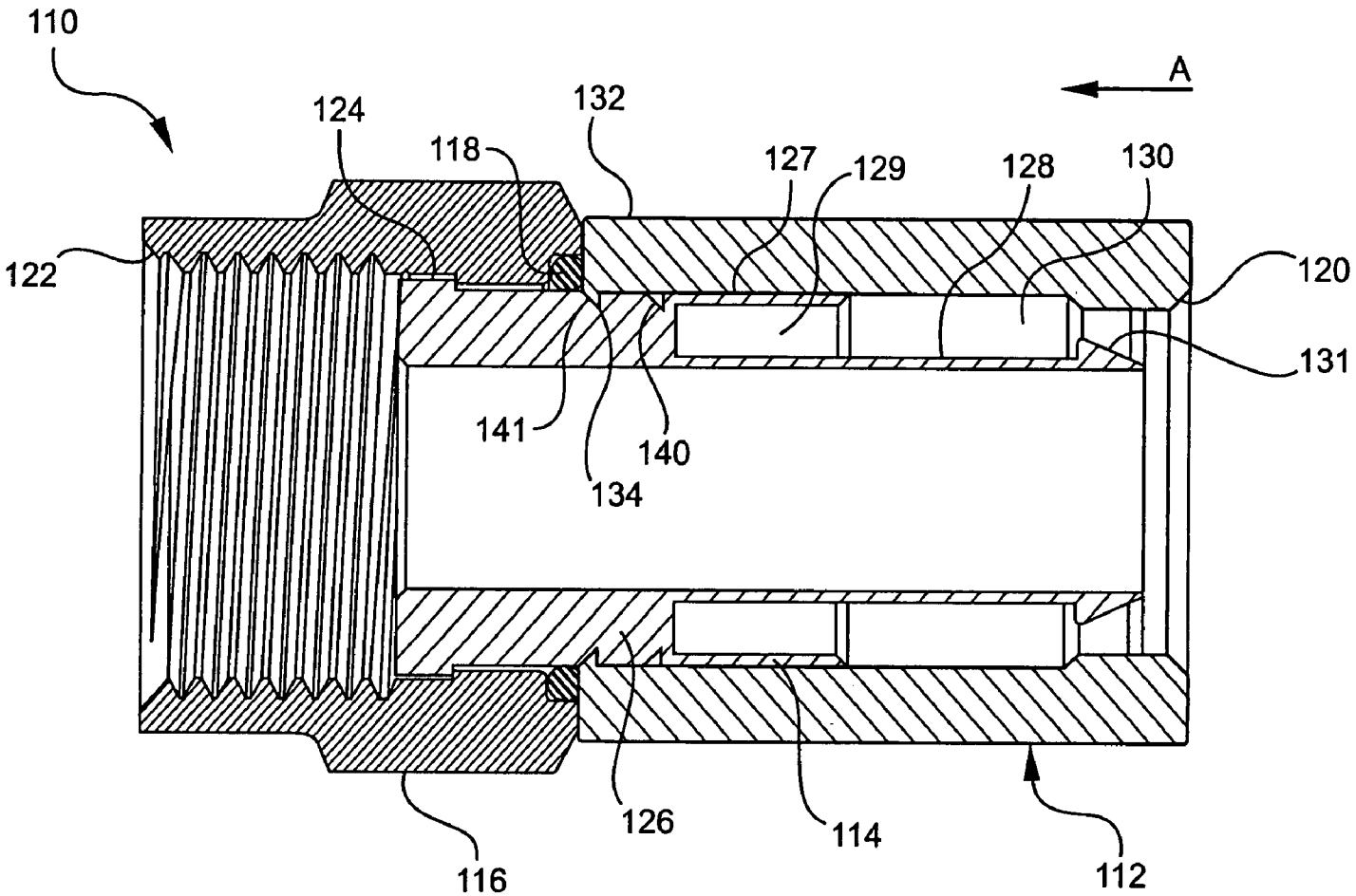
FIG. 9 is a cross-sectional view of the connector shown in FIG. 6 with the movable collar in its second closed position.

Referring additionally to FIGS. 8 and 9, the collar 112 includes a cable receiving end 120 for insertably receiving a prepared end of a coaxial cable. The nut 116 includes an internally threaded end extent 122 permitting screw threaded attachment of the connector body 110 to the external device. The cable receiving end 120 and the internally threaded end extension 122 define opposite ends of the connector 110.

The annular post 114 includes a flanged base portion 124 which provides for press-fit securement of the post within a post receiving space in the nut 116. The annular post 114 further includes an elongated annular shoulder portion 126 having an outer surface, which provides for movable attachment of the collar 112 to the post. However, in this embodiment, the post 114 also includes an annular sleeve portion 127 extending rearwardly from the shoulder portion and an annular tubular extension 128 extending from within the sleeve portion into the collar. The sleeve portion 127 and the tubular extension 128 of the post 114 define an annular pocket 129 therebetween and the post extension 128 and the collar 112 define an annular chamber 130. The distal end of the tubular extension 128 includes a radially outwardly extending ramped flange portion 131 for compressing the outer jacket of the coaxial cable in the annular chamber 130 between the flange portion and the internal diameter of the collar 112 to secure the cable within the connector. As will be described in further detail herein below, both the pocket 129 and the chamber 130 are designed for accommodating the jacket and shield of the inserted coaxial cable.

Opposite the cable receiving end 120 of the collar 112 is a forward end 132 which is movably coupled to the outer surface of the shoulder portion 126 of the post 114. As discussed above, the forward end 132 of the collar 112 and the shoulder portion 126 of the post 114 preferably include cooperative detent structure which allows for the movable connection of the collar 112 to the post 114 such that the collar is axially moveable along arrow A of FIGS. 8-12, towards nut 116 from a first position shown in FIG. 8, which loosely retains the cable within the connector body 110, to a more forward second position shown in FIG. 9, which secures the cable within the connector. Alternatively, since the collar may first be slipped onto the cable before insertion of the cable into the post, only the second, locked position may be provided with cooperating structure to lock the collar in the closed position.

As mentioned above, the connector 110 of the present invention is constructed so as to be supplied in the pre-assembled condition shown in FIGS. 6 and 7, wherein the collar 112 is temporarily attached to the post 114 by the detachable arm 113. In a preferred method of installation, the collar 112, which is still attached to the post 114 in its pre-assembled condition, is slipped onto an end of a prepared cable 150. Once positioned on the cable 150, the collar 112 is detached from the post 114 via the frangible arm 113. In this manner, there is less chance that the installer will drop or lose either of the two components of the connector assembly. After detaching the collar 112 from such pre-assembled condition, and as will be described in further detail herein below, a coaxial cable may be inserted through the rearward end 120 of the collar 112 and connected directly to the post 114. Thereafter, the collar 112 may be attached to the post 114 where it can be moved from the first position to the second position locking the cable within the connector.

Figure 10:
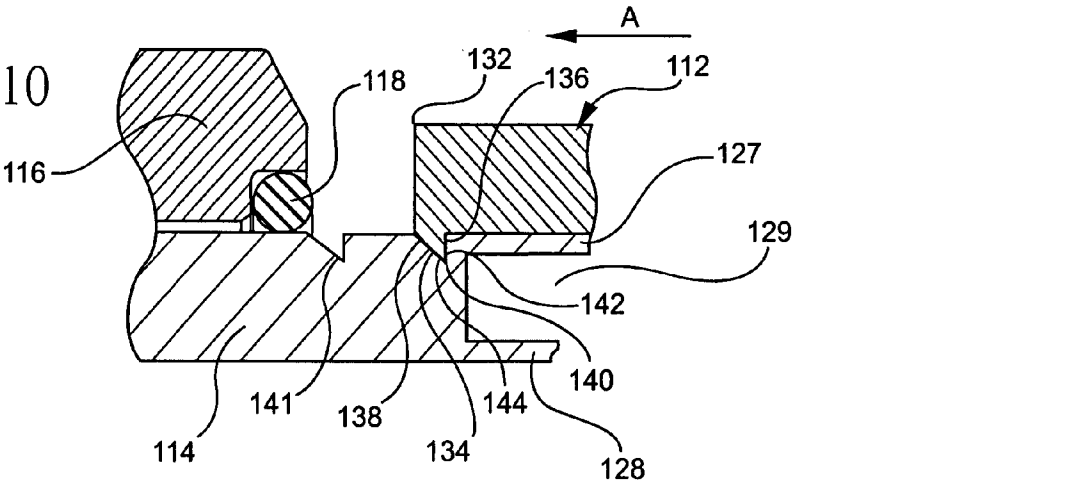
FIG. 10 is a detailed view of the cooperating detent structure shown in FIGS. 7, 8 and 9.

With additional reference to FIG. 10, the cooperating detent structure is shown. Forward end 132 of the collar 112 includes a radially inwardly directed annular rib 134 extending adjacent the distal end thereof. Rib 134 is defined by a rearwardly facing perpendicular wall 136 and a forwardly facing chamfered wall 138. The cooperating detent structure of the present invention further includes the shoulder portion 126 of the post 114 formed to have two radially outwardly opening annular grooves 140 and 141 constructed so as to receive the rib 134 of the collar 112. The grooves 140 and 141 are axially spaced on the shoulder portion 126 of the post to define a rearward groove 140 and a forward groove 141. Both grooves 140 and 141 may include a forwardly facing perpendicular wall 142 and a rearwardly facing chamfered wall 144, which respectively engage the perpendicular wall 136 and the chamfered wall 138 of the collar rib 134. Where it is desired to have the collar 112 detachable from the post 114 after the collar has been placed in its first position, it is preferable to eliminate the perpendicular wall 142 from the rearward groove 140 and substitute a forwardly facing chamfered wall in its place.

As may be appreciated, the forward end 132 of the collar 112 may be fitted over the sleeve portion 127 of the post 114 and slid forward until the rib 134 of the collar comes to rest within the rearward groove 140 of the post shoulder portion 126. To facilitate such initial assembly of the collar 112 to the post 114, the rib 134 is provided with a forward facing chamfered wall 138, as described above. By its tubular shape, the collar 112 will have some resiliency at its forward end 132 which will allow the rib 134 to ride over the sleeve portion 127 of the post 114 until the rib becomes lockingly resident within the rearward groove 140 of the post shoulder portion 126. This defines the first position of the collar 112.

As mentioned above, the cooperative detent structure of the present invention further includes a radially outwardly extending forward groove 141 formed on the shoulder portion 126 of the post 114 adjacent the rearward groove 140. Upon continued coaxial movement of the collar 112 along arrow A, the rib 134 of the collar disengages the rearward groove 140 and becomes resident within the forward groove 141 to define the second position of the collar which locks the collar in this position, thereby locking the cable within the connector.

Figure 11:
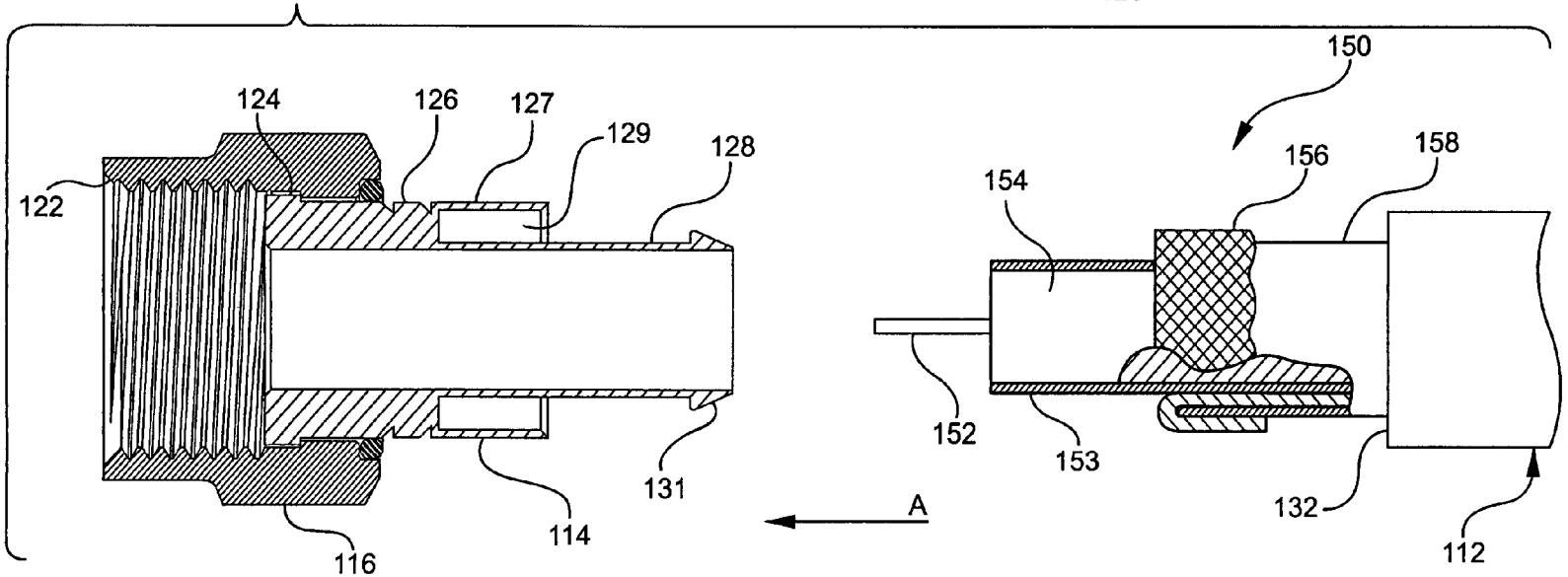
FIG. 11 is an exploded cross-sectional view of the termination of a prepared coaxial cable prior to insertion within the connector of the present invention.
Figure 12:
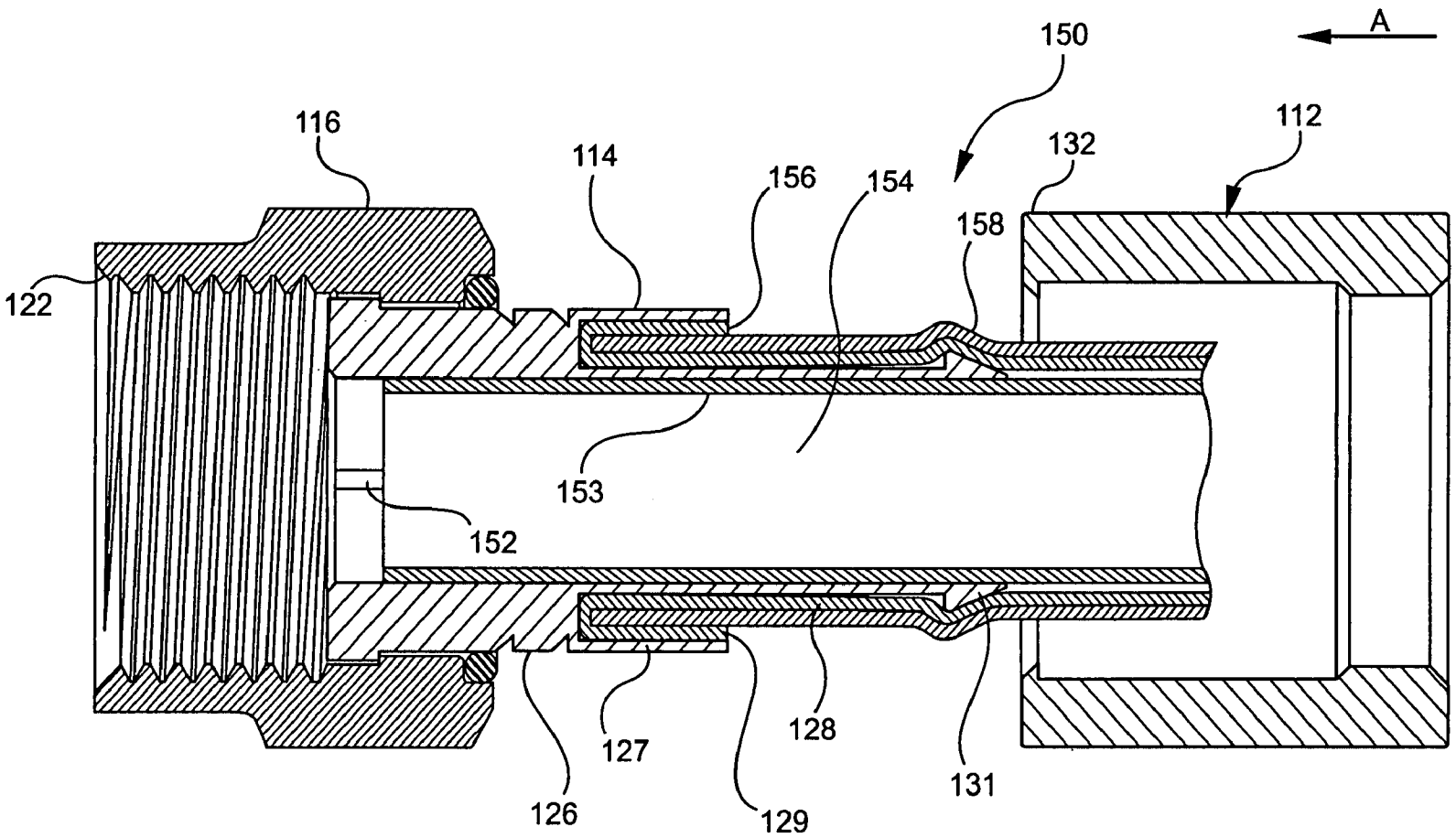
FIG. 12 is an exploded cross-sectional view of the termination of a prepared coaxial cable after insertion within the connector of the present invention.

Referring to FIGS. 11 and 12, coaxial cable 150 is prepared in conventional fashion for termination by stripping back jacket 158 exposing an extent of shield 156. A portion of the foil covered insulator 154 extends therefrom with an extent of conductor 152 extending from insulator 154. The preparation process includes folding back an end extent of shield 156 about jacket 158.

Again, proper insertion of the cable 150 into the connector body 110 requires that the cable be inserted in such a manner that the extension 128 of the post 114 becomes resident between the foil covered insulator 154 and the shield 156. Thus, as shown in exploded view in FIGS. 11 and 12, the collar 112 of the connector assembly 110 is preferably slipped over the end of a coaxial cable 150 and moved to a convenient position along the cable length prior to connecting the cable to the post 114. The post 114 may then be detached from the arm ring 115 and the frangible arm extension 117 may be detached from the collar 112. If desired, the installer may detach the collar prior to slipping the collar on the cable depending upon the installation. In either event, the collar 112 is oriented on the cable 150 so that the forward end 132 of the collar faces the end of the cable which will be prepared and inserted into the post 114. The end of the foil covered insulator 154 may then be inserted directly into the post extension 128 so that the extension is interposed between the foil covered insulator 154 and the shield 156. The cable 150 is then further pushed forward whereby the folded-over portion of the shield 156 is inserted into the post pocket 129 defined between the post sleeve portion and the post tubular extension 128, as shown in FIG. 12. The folded-over portion of the shield 156 that becomes resident within the post pocket 129 is now protected from damage which may occur upon further assembly of the connector. In particular, the post pocket 129 protects the exposed portion of the shield 156 from damage that may be caused by the collar 112 as it is moved forward on the post 114 to lock the cable 150 within the connector 110 as described further below.

Thereafter, the collar 112 may be brought up along the cable 150 and the forward end 132 of the collar may be slipped forward over the sleeve portion 127 and the shoulder portion 126 of the post 114 until the collar rib 134 becomes resident within the rearward groove 140 as shown in FIGS. 8 and 9 defining the first position. As previously mentioned, it is also contemplated that no structure may be necessary to hold the collar 112 in the first position in this alternative embodiment.

Once the cable 150 is properly inserted and the collar 112 is set in its first position, the collar is then further moved axially forward from the first position shown in FIGS. 8 and 10, to the second position shown in FIG. 9. When the collar 112 is moved axially forward, the rib 134 formed in the forward end 132 of the collar 112 disengages the rearward groove 140 formed in the shoulder portion 126 of the post 114. Such movement is facilitated by the forward facing chamfered wall 138 of the collar rib 134 and the cooperating rearward facing chamfered wall 144 of the rearward groove 140. The collar 112 is moved axially forward until the collar rib 134 engages the forward groove 141 formed in the shoulder portion 126 of the post 114. A suitable tool may be used to effect movement of the collar 112 from its first position to its second position securing the cable 150 to the connector 110. In this second position, the jacket 158 of the cable 150 becomes compressively clamped within the annular chamber 130 between the extension 128 of the post 114 and the collar 112. Also, the perpendicular walls 136 and 142 of the rib 134 and the forward groove 141 help to maintain the collar 112 in the second position with respect to the post 114 thereby locking the cable 150 within the connector 110.

Alternatively, the collar 112 may first be assembled to the post 114 in its first position as shown in FIGS. 8 and 10 and the cable 150 may be subsequently inserted into the collar. In this scenario, the prepared cable 150 is inserted through the rearward end 120 of the collar 112 while the collar is connected to the post 114 in its first position. The extension 128 of the post 114 is inserted between the insulator 154 and the metallic shield 156 such that the folded-over portion of the shield resides within the post pocket 129 defined between the post sleeve portion 127 and the tube extension 128 and the uncovered jacket 158 resides within the annular region 130 defined between the post 114 and the collar 112. When the collar 112 is coupled to the post 114 in the first position, as shown in FIGS. 8 and 10, sufficient clearance is provided between the collar and the post so that extension 128 may be easily interposed between the insulator 154 and the shield 156 of the cable 150.

Thereafter, as described above, the collar 112 may be moved from the first position shown in FIGS. 8 and 10 to a second position shown in FIG. 9 where the rib 134 becomes resident within the forward groove 141 of the post 114 thereby locking the cable 150 within the connector 110.

Figure 13:
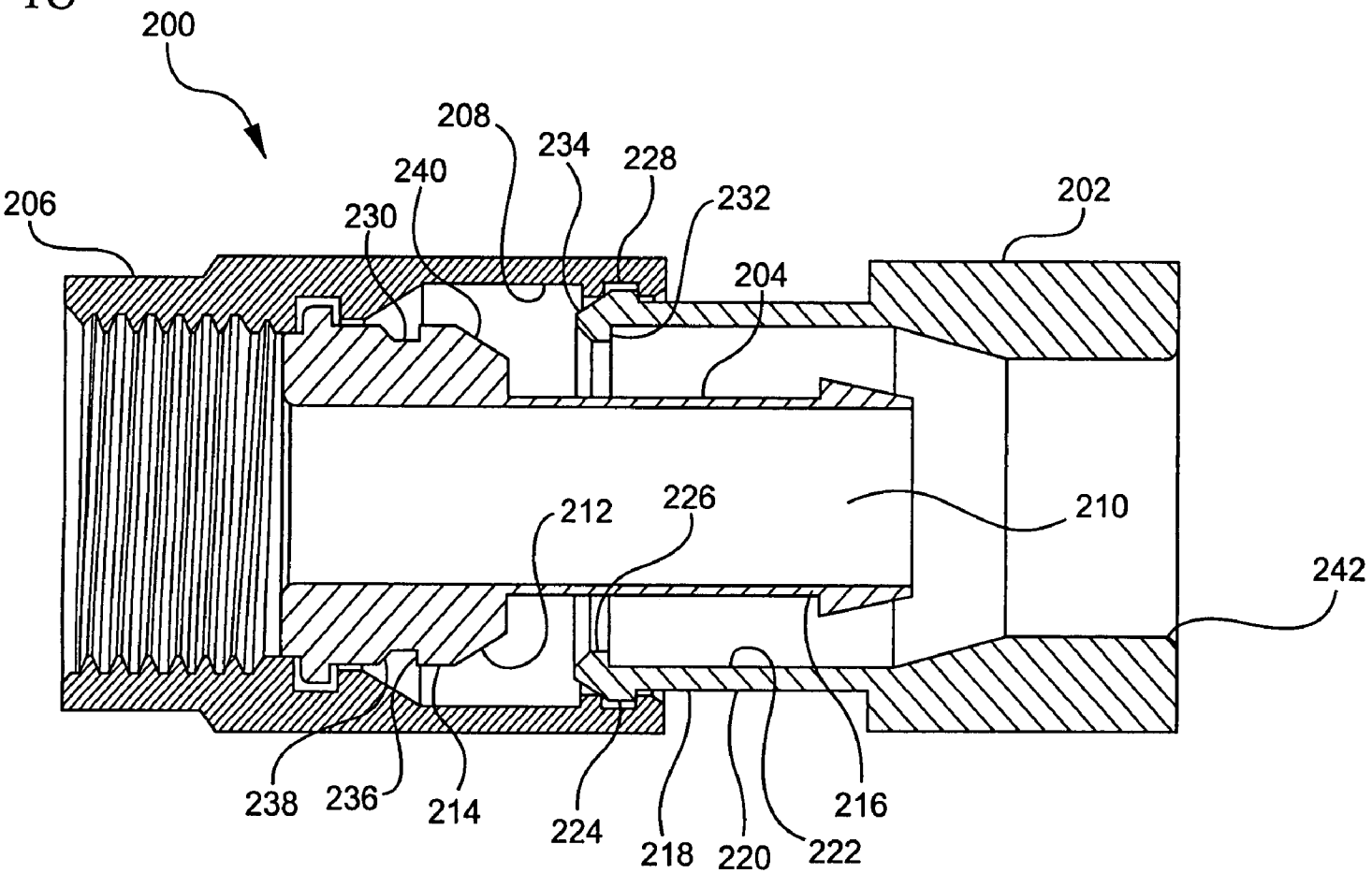
FIG. 13 is a cross-sectional view of another alternative embodiment of the present invention showing the collar in its first position.
Figure 14:
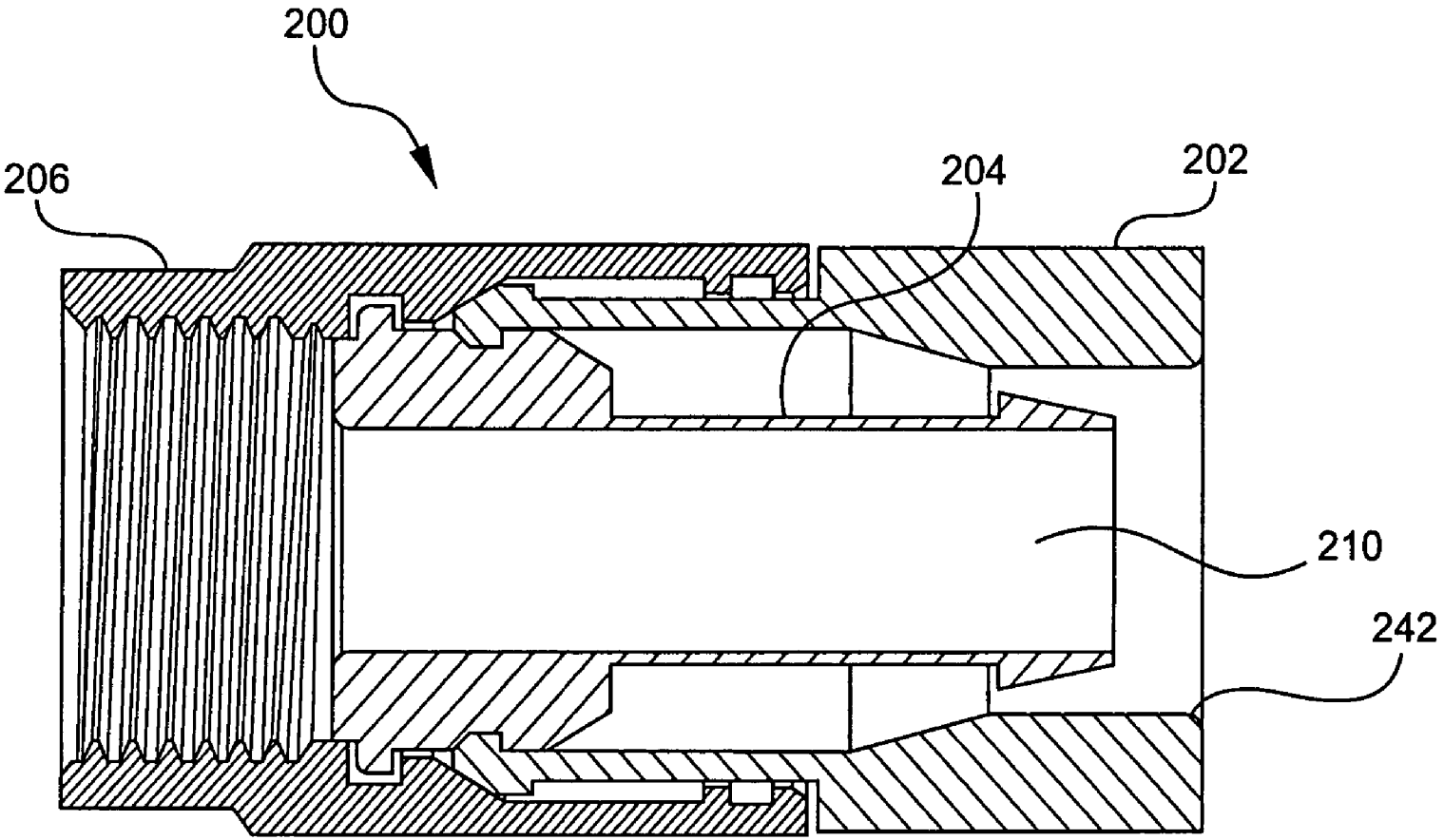
FIG. 14 is a cross-sectional view of the alternative embodiment shown in FIG. 13 showing the collar in its second or locked position.

Referring now to FIGS. 13 and 14, still another alternative embodiment of the coaxial cable connector 200 of the present invention is shown. The connector 200 includes the same three major components: a movable collar 202; an annular post 204; and a rotatable nut 206. However, in this embodiment, the movable collar 202 is coupled to the nut 206 in a first position and is movable to a second position, wherein the collar is coupled to the post 204.

In particular, the nut 206 in this embodiment extends further rearwardly and includes a rearward interior surface 208 having structure to engage the collar 202 in a first position. The post 204 again includes an axial bore 210 therein, a shoulder portion 212 defined by an outer surface 214 and a tubular extension 216 extending axially rearwardly from the shoulder portion. However, in this embodiment, the outer surface 214 of the post shoulder portion 212 includes structure for coupling the collar 202 only in its second position. To accomplish this, the forward end 218 of the collar includes structure on both its outer surface 220 and its inner surface 222 to respectively engage the inner surface 208 of the nut 206 and the outer surface 214 of the post shoulder portion 212.

Again, the securing means for coupling the collar 202 to the other connector components preferably takes the form of cooperating detent structure, wherein the outer surface 220 of the collar 202 includes an outwardly extending annular rib 224 formed thereon and the inner surface 222 of the collar includes an inwardly extending annular rib 226 formed thereon. Conversely, the inner surface 208 of the nut 206 includes a first annular groove 228 formed thereon and the outer surface 214 of the post shoulder portion 212 includes a second annular groove 230 formed thereon.

As described above, the annular ribs 224 and 226 and grooves 228 and 230 may be reversed, wherein the grooves are provided on the collar and the ribs are provided on the nut and the post. As also described above, the annular ribs 224 are preferably defined by a rearwardly facing perpendicular wall 232 and a forwardly facing chamfered wall 234 and the annular grooves 228 and 230 are preferably defined by a forwardly facing perpendicular wall 236 and a rearwardly facing chamfered wall 238 to permit only forward movement of the collar. Moreover, the post shoulder portion 212 of this embodiment may also include a rearwardly facing chamfered wall 240 at a transition between the shoulder portion and the tubular extension 216 to facilitate attachment of the collar 202 to the post. Finally, the post may further include an annular sleeve portion (not shown in FIGS. 13 and 14) extending rearwardly from the shoulder portion 212, which defines an annular pocket between the sleeve portion and the tubular extension, as shown in FIGS. 6-12.

Use of the cable connector 200 shown in FIGS. 13 and 14 is similar to that described above. Specifically, a coaxial cable may be inserted through the rearward end 242 of the collar 202 and the collar may then be moved from its first position, as shown in FIG. 13, thereby loosely retaining the cable, to an axially forward second position, as shown in FIG. 14, thereby locking the cable within the connector.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

an annular post defining an axial bore therein, said post having a forward flanged base portion, a shoulder portion and a tubular extension, said shoulder portion extending in a rearward direction from said flanged base portion and including an outer engagement surface formed thereon, said outer engagement surface terminating together with said shoulder portion at a rearward end of said outer engagement surface, and said tubular extension being connected directly to said rearward end and extending axially in said rearward direction from said rearward end, said flanged base portion, said shoulder portion and said tubular extension being an integral unitary member; wherein said outer surface of said shoulder portion is defined by a first outer diameter, wherein said flanged base portion is defined by a second outer diameter, said second outer diameter being greater than said first outer diameter; and wherein said tubular extension is defined by a third outer diameter, said third outer diameter being smaller then said first outer diameter;

a cylindrical collar having a forward end movably engaged with said outer engagement surface of said post shoulder portion for axial movement between a first open position to receive a prepared coaxial cable and a second closed position to lock the cable in the connector; and a nut rotatably engaged to said post shoulder portion.

2. A coaxial cable connector as defined in claim 1, further comprising a sealing ring disposed between said post, said collar and said nut.

3. A coaxial cable connector as defined in claim 1, wherein said outer surface of said post shoulder portion and said forward end of said collar include cooperating detent structure for permitting axial movement of said collar and said post from said first position to said second position.

4. A coaxial cable connector as defined in claim 3, wherein said cooperating detent structure comprises an annular rib formed on one of said forward end of said collar and said outer surface of said post shoulder portion and two axially spaced annular grooves formed on the other of said forward end of said collar and said outer surface of said post shoulder portion.

5. A coaxial cable connector as defined in claim 4, wherein said annular rib is provided on said collar and is defined by a rearwardly facing perpendicular wall and a forwardly facing chamfered wall and said grooves are provided on said outer surface of said post shoulder portion and are defined by a forwardly facing perpendicular wall and a rearwardly facing chamfered wall to permit only forward movement of said collar on said post.

6. A coaxial cable connector as defined in claim 1, wherein said collar is movable with respect to said post from said first open position for loosely retaining a coaxial cable within the connector to said second closed position for securing the cable within the connector.

7. A coaxial cable connector as defined in claim 1, wherein said forward end of said collar is press-fit on said outer surface of said post shoulder portion.

8. A coaxial cable connector as defined in claim 1, wherein said forward end of said collar is threadably engaged with said outer surface of said post shoulder portion.

9. A coaxial cable connector as defined in claim 1, wherein said post shoulder portion includes a rearwardly facing chamfered wall at a transition between said shoulder portion and said tubular extension to facilitate attachment of said collar to said post.

10. A coaxial cable connector as defined in claim 1, wherein said collar is detachably coupled to said post.

11. A coaxial cable connector as defined in claim 1, wherein said collar includes a detachable arm extending outwardly therefrom for temporarily attaching said collar to said post in an initial configuration.

12. A coaxial cable connector as defined in claim 11, wherein said detachable arm comprises a ring extension extending radially outwardly from said collar and a ring disposed at an end of said ring extension for attaching said collar to said post, said ring being sized to be snugly fit on said outer surface of said post shoulder portion.

13. A coaxial cable connector as defined in claim 12, wherein said ring includes a slot breaking the continuity of said ring for facilitating perpendicular attachment of said ring to said post shoulder portion.

14. A coaxial cable connector as defined in claim 12, wherein said outer surface of said post shoulder portion and said ring include cooperating detent structure for facilitating attachment of said ring to said post shoulder portion.

15. A coaxial cable connector as defined in claim 12, wherein said ring extension includes a frangible portion disposed where the extension meets the collar.

16. A coaxial cable connector as defined in claim 1, wherein said outer surface of said shoulder portion is defined by said first outer diameter, and wherein said nut is defined by a minimum inner diameter, said minimum inner diameter of said nut being greater than said first outer diameter of said shoulder portion.

17. A coaxial cable connector as defined in claim 2, wherein said sealing ring is in sealing contact with said outer surface of said post shoulder portion.

18. A coaxial cable connector comprising:

a one-piece annular post having a forward flanged base portion, a shoulder portion and a tubular extension, said shoulder portion extending in a rearward direction from said flanged base portion and including a radially outwardly facing engagement surface extending in a rearward direction and terminating radially outwardly facing engagement surface at a rearward end of said shoulder, and said tubular extension being connected directly to said rearward end and extending axially in said rearward direction from said rearward end; wherein said engagement surface of said shoulder portion is defined by a first outer diameter, wherein said flanged base portion is defined by a second outer diameter, said second outer diameter being greater than said first outer diameter; and wherein said tubular extension is defined by a third outer diameter, said third outer diameter being smaller then said first outer diameter;

a cylindrical collar having a forward end movably engaged with said outer engagement surface of said post shoulder portion for axial movement between a first open position to receive a prepared coaxial cable and a second closed position to lock the cable in the connector; and a nut rotatably engaged to said post shoulder portion, said outer engagement surface of said one-piece annular post being insertable within said nut to assemble said nut to said post.

19. A coaxial cable connector as defined in claim 18, wherein said outer engagement surface of said post shoulder portion is defined by said first outer diameter, and wherein said nut is defined by a minimum inner diameter, said minimum inner diameter of said nut being greater than said first outer diameter of said shoulder portion.

20. A coaxial cable connector as defined in claim 18, further comprising a sealing ring in sealing contact with said engagement surface of said post shoulder portion.

* * * * *

UNITED STATES PATENT AND TRADEMARK OFFICE

CERTIFICATE OF CORRECTION

PATENT NO. : 7,241,172 B2
APPLICATION NO. : 11/104334
DATED : July 10, 2007
INVENTOR(S) : Julio Rodrigues et al.

It is certified that error appears in the above-identified patent and that said Letters Patent is hereby corrected as shown below:

IN THE CLAIMS

Column 14, lines 64-66, now reads "terminating radially outwardly facing engagement surface at a rearward end of said shoulder,"

should read --terminating together with said shoulder portion at a rearward end of said radially outwardly facing engagement surface--.

Signed and Sealed this

Twenty-seventh Day of November, 2007

JON W. DUDAS
*Director of the United States Patent and Trademark Office*